US007920802B2

(12) United States Patent
Minagawa

(10) Patent No.: US 7,920,802 B2
(45) Date of Patent: Apr. 5, 2011

(54) HEATING CONTROL DEVICE, FIXING DEVICE, IMAGE FORMING APPARATUS, HEATING CONTROL METHOD, AND COMPUTER PROGRAM PRODUCT

(75) Inventor: Hiroyuki Minagawa, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 338 days.

(21) Appl. No.: 11/723,077

(22) Filed: Mar. 16, 2007

(65) Prior Publication Data

US 2007/0217810 A1 Sep. 20, 2007

(30) Foreign Application Priority Data

Mar. 17, 2006 (JP) ..... 2006-075553
Dec. 22, 2006 (JP) ..... 2006-345598

(51) Int. Cl.
*G03G 15/20* (2006.01)

(52) U.S. Cl. ..... 399/69; 399/329

(58) Field of Classification Search ..... 399/69
See application file for complete search history.

(56) References Cited

U.S. PATENT DOCUMENTS

| | | | | |
|---|---|---|---|---|
| 6,763,206 | B2 * | 7/2004 | Kinouchi et al. | 399/70 |
| 2003/0219270 | A1 * | 11/2003 | Kondo | 399/69 |
| 2004/0264991 | A1 * | 12/2004 | Yoshikawa | 399/69 |
| 2005/0185977 | A1 * | 8/2005 | Kamei | 399/69 |
| 2005/0201767 | A1 * | 9/2005 | Peng et al. | 399/69 |
| 2005/0286919 | A1 * | 12/2005 | Matsumoto | 399/69 |

FOREIGN PATENT DOCUMENTS

| | | |
|---|---|---|
| JP | 11-344885 | 12/1999 |
| JP | 2001-201978 | 7/2001 |
| JP | 2002-221871 | 8/2002 |
| JP | 2002-296954 | 10/2002 |
| JP | 2003-149987 | 5/2003 |
| JP | 2005-017757 | 1/2005 |

* cited by examiner

*Primary Examiner* — David M Gray
*Assistant Examiner* — Roy Yi
(74) *Attorney, Agent, or Firm* — Harness, Dickey & Pierce, P.L.C.

(57) ABSTRACT

A fixing device fixes an image on a recording medium by allowing the recording medium to pass through a nip between a pair of rotating members at least one of which is heated. The fixing device includes heaters that heat rotating members, temperature sensing elements that sense the temperature of the rotating members, and an I/O control panel. The I/O control panel calculates the amount of heat generated by the heaters based on the temperature sensed by the temperature sensing elements, and corrects calculation result according to medium information to control the heaters.

20 Claims, 22 Drawing Sheets

| FIG. 13A |
| --- |
| FIG. 13B |

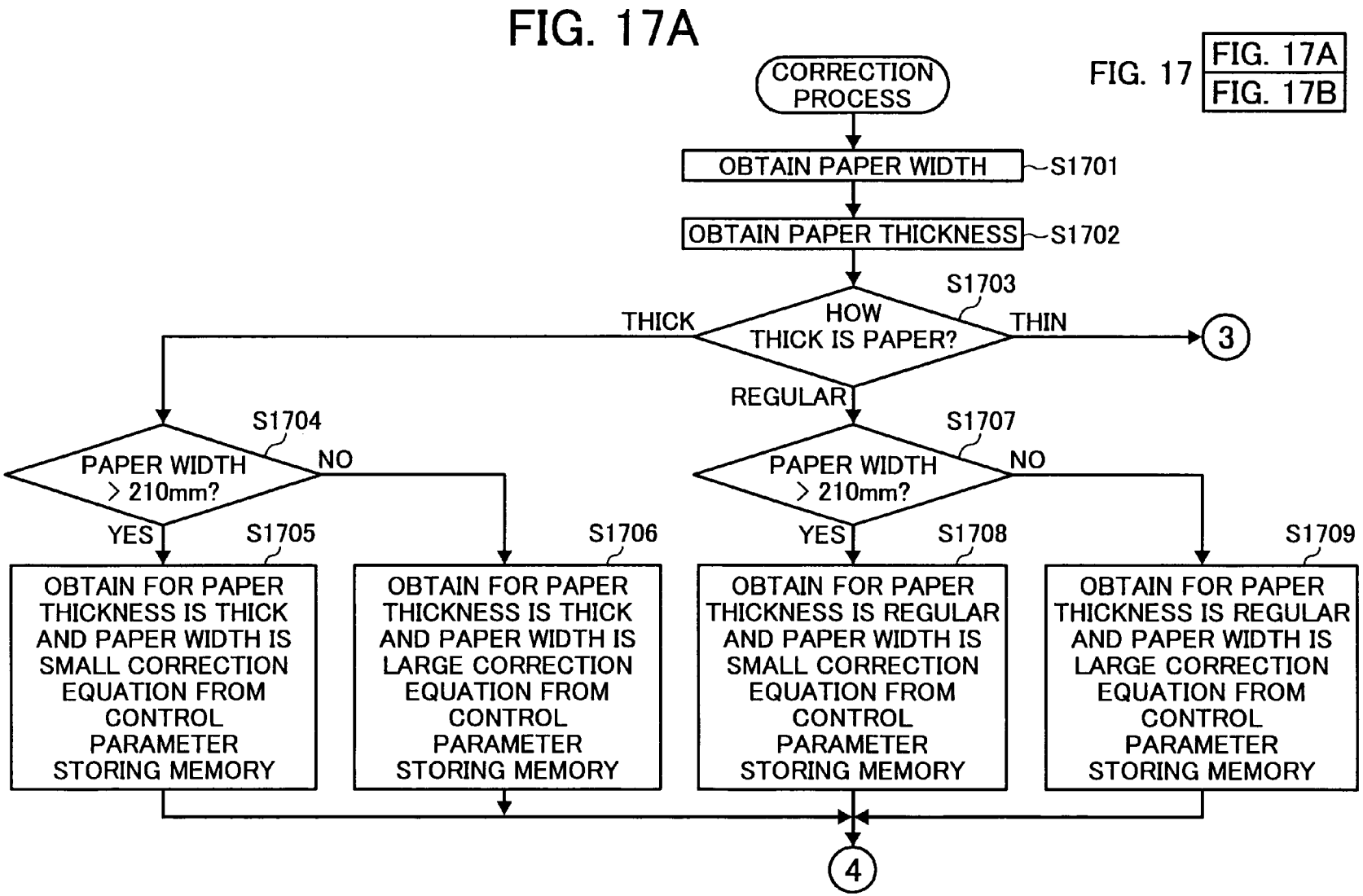
FIG. 17A
FIG. 17B
FIG. 17
CORRECTION PROCESS
OBTAIN PAPER WIDTH
S1701
OBTAIN PAPER THICKNESS
S1702
S1703
HOW THICK IS PAPER?
THICK
REGULAR
THIN
3
S1704
PAPER WIDTH > 210mm?
YES
NO
S1705
OBTAIN FOR PAPER THICKNESS IS THICK AND PAPER WIDTH IS SMALL CORRECTION EQUATION FROM CONTROL PARAMETER STORING MEMORY
S1706
OBTAIN FOR PAPER THICKNESS IS THICK AND PAPER WIDTH IS LARGE CORRECTION EQUATION FROM CONTROL PARAMETER STORING MEMORY
S1707
PAPER WIDTH > 210mm?
YES
NO
S1708
OBTAIN FOR PAPER THICKNESS IS REGULAR AND PAPER WIDTH IS SMALL CORRECTION EQUATION FROM CONTROL PARAMETER STORING MEMORY
S1709
OBTAIN FOR PAPER THICKNESS IS REGULAR AND PAPER WIDTH IS LARGE CORRECTION EQUATION FROM CONTROL PARAMETER STORING MEMORY
4

FIG. 18

PAPER WIDTH EXCEEDING 210 MILLIMETERS AND REGULAR THICKNESS

| | | EDGE HEATER TURN- ON RATE Mvb | | |
|---|---|---|---|---|
| | | 0 TO 49% | 50 TO 79% | 80 TO 100% |
| CENTER HEATER TURN-ON RATE Mva | 0 TO 49% | Mva' =Mva<br>Mvb' =Mvb | Mva' =Mva<br>Mvb' =Mvb | Mva' =Mva<br>Mvb' =Mvb |
| | 50 TO 79% | Mva' =Mva<br>Mvb' =Mvb*0.9 | Mva' =Mva*0.9<br>Mvb' =Mvb*0.9 | Mva' =Mva*0.9<br>Mvb' =Mvb*0.6 |
| | 80 TO 100% | Mva' =Mva<br>Mvb' =Mvb*0.9 | Mva' =Mva*0.9<br>Mvb' =Mvb*0.8 | Mva' =Mva*0.8<br>Mvb' =Mvb*0.5 |

Mvc' =Mvc−(Mva' +Mvb' )*0.1

FIG. 19

PAPER WIDTH EQUAL TO OR SMALLER THAN 210 MILLIMETERS AND REGULAR THICKNESS

| | | EDGE HEATER TURN- ON RATE Mvb | | |
|---|---|---|---|---|
| | | 0 TO 49% | 50 TO 79% | 80 TO 100% |
| CENTER HEATER TURN-ON RATE Mva | 0 TO 49% | Mva' =Mva<br>Mvb' =Mvb*0.8 | Mva' =Mva<br>Mvb' =Mvb*0.8 | Mva' =Mva<br>Mvb' =Mvb*0.7 |
| | 50 TO 79% | Mva' =Mva<br>Mvb' =Mvb*0.8 | Mva' =Mva*0.9<br>Mvb' =Mvb*0.7 | Mva' =Mva*0.9<br>Mvb' =Mvb*0.5 |
| | 80 TO 100% | Mva' =Mva<br>Mvb' =Mvb*0.7 | Mva' =Mva*0.9<br>Mvb' =Mvb*0.6 | Mva' =Mva*0.8<br>Mvb' =Mvb*0.4 |

Mvc' =Mvc−(Mva' +Mvb' )*0.1

FIG. 20

PAPER WIDTH EXCEEDING 210 MILLIMETERS AND LARGE THICKNESS

| | | EDGE HEATER TURN- ON RATE Mvb | | |
|---|---|---|---|---|
| | | 0 TO 49% | 50 TO 79% | 80 TO 100% |
| CENTER HEATER TURN-ON RATE Mva | 0 TO 49% | Mva' =Mva*1.1<br>Mvb' =Mvb*1.1 | Mva' =Mva*1.1<br>Mvb' =Mvb*1.1 | Mva' =Mva*1.1<br>Mvb' =Mvb |
| | 50 TO 79% | Mva' =Mva*1.1<br>Mvb' =Mvb | Mva' =Mva<br>Mvb' =Mvb | Mva' =Mva<br>Mvb' =Mvb*0.6 |
| | 80 TO 100% | Mva' =Mva*1.1<br>Mvb' =Mvb*0.9 | Mva' =Mva<br>Mvb' =Mvb*0.8 | Mva' =Mva<br>Mvb' =Mvb*0.5 |

Mvc' =Mvc(Mva'+Mvb')*0.1

FIG. 21

PAPER WIDTH EQUAL TO OR SMALLER THAN 210 MILLIMETERS AND LARGE THICKNESS

| | | EDGE HEATER TURN- ON RATE Mvb | | |
|---|---|---|---|---|
| | | 0 TO 49% | 50 TO 79% | 80 TO 100% |
| CENTER HEATER TURN-ON RATE Mva | 0 TO 49% | Mva' =Mva*1.1<br>Mvb' =Mvb*0.8 | Mva' =Mva*1.1<br>Mvb' =Mvb*0.8 | Mva' =Mva*1.1<br>Mvb' =Mvb*0.7 |
| | 50 TO 79% | Mva' =Mva*1.1<br>Mvb' =Mvb*0.8 | Mva' =Mva<br>Mvb' =Mvb*0.7 | Mva' =Mva<br>Mvb' =Mvb*0.5 |
| | 80 TO 100% | Mva' =Mva<br>Mvb' =Mvb*0.7 | Mva' =Mva<br>Mvb' =Mvb*0.6 | Mva' =Mva<br>Mvb' =Mvb*0.4 |

Mvc' =Mvc(Mva'+Mvb')*0.1

HEATING CONTROL DEVICE, FIXING DEVICE, IMAGE FORMING APPARATUS, HEATING CONTROL METHOD, AND COMPUTER PROGRAM PRODUCT

CROSS-REFERENCE TO RELATED APPLICATIONS

The present document incorporates by reference the entire contents of Japanese priority document, 2006-075553 filed in Japan on Mar. 17, 2006 and Japanese priority document, 2006-345598 filed in Japan on Dec. 22, 2006.

BACKGROUND OF THE INVENTION

1. Field of the Invention

The present invention relates to a heating control device, a fixing device, an image forming apparatus, a heating control method, and a computer program product.

2. Description of the Related Art

A fixing device has been known in which a pair of rotating members facing to each other are heated by respective heat sources, one of the rotating members is pressed at a predetermined pressure to form a nip between both the rotating members, and paper is allowed to pass through the nip, and an image is fixed on the paper.

For example, Japanese Patent Application Laid-Open No. 2002-221871 discloses an image forming apparatus in which a heater for a heating roller is controlled by detection outputs from a temperature sensor of the heating roller or a temperature sensor of a pressure roller. More specifically, the heater of the heating roller is controlled based on the temperature of the pressure roller and the heater of the heating roller is controlled based on the temperature of the heating roller. In addition, the heater of the heating roller is controlled based on the temperature change of the pressure roller.

As another example, Japanese Patent Application Laid-Open No 2003-149987 discloses a technology in which a target temperature of the heating roller is calculated based on the detected temperature of the pressure roller, and the heat source of the heating roller is controlled based on the calculated target temperature of the heating roller and the detected temperature of the heating roller.

In both of the conventional technologies, each of the heat sources for the heating rollers is controlled based on the detected temperature of the pressure roller. However, turn-ON and OFF of the heat source of the heating roller is merely performed (or input is reduced) based on the detected temperature of the pressure roller.

In some fixing devices, fixing control has been performed with the use of proportional-integral-derivative (PID) control; however, the control is performed using a temperature sensed by a single temperature sensing element corresponding to each of the heat sources. The example is shown in FIG. 22. Using each temperature detected by each of the temperature sensing elements corresponding to the respective heat sources, a turn-on rate (control amount Mv) for each heater is obtained from the difference between the target temperature and the detected temperature by PID in FIG. 22 (see FIGS. 1 to 4 for this structure example).

However, in the conventional technologies as described above, when fixation is performed by allowing paper to pass through a nip between a pair of heated rotating members, an increase in temperature of the edge of the rotating members where the paper does not pass through (non-paper feeding portion) becomes larger compared to that of the portion where the paper passes when sheets of paper having a width shorter than that of the rotating members are continuously fed. More specifically, in conventional cases, the temperature of the non-paper feeding portion sometimes increases much more than necessity by turning ON two or more heat sources at the same time when the temperature is merely controlled independently such that a first heating unit (center heater) is PID controlled based on the temperature detected by a first temperature detecting unit (temperature sensing element (heating edge)) and a second heating unit (edge heater) is PID controlled based on the temperature detected by a second temperature detecting unit (temperature sensing element (heating center)), and thus there is a fear that temperature variation becomes larger. For example, when a paper size is A4, a temperature distribution in the edge of the rotating members becomes different between when the paper is transversely delivered (width of 297 millimeters) and when it is vertically delivered (width of 210 millimeters). When paper has a small width, an increase in temperature of the non-paper feeding portion becomes larger because heat is not removed from the non-paper feeding portion by the paper. In the design, the heaters are commonly set to a fixing temperature suitable for the maximum paper width (including thick paper) to secure fixation. Therefore, the temperature increase cannot be avoided. In other words, when a paper width is small, a temperature difference is generated between the paper feeding portion and the non-paper feeding portion, and the temperature of the non-paper feeding portion increases, which is not desirable in view of power consumption and safety standards. Accordingly, power saving is hindered and further a temperature increase in the apparatus is generated.

SUMMARY OF THE INVENTION

It is an object of the present invention to at least partially solve the problems in the conventional technology.

According to an aspect of the present invention, a heating control device includes a first heating unit that heats a member, a second heating unit that heats the member, a first temperature sensing unit that senses first temperature of the member in a first position corresponding to the first heating unit, a second temperature sensing unit that senses second temperature of the member in a second position corresponding to the second heating unit, a first control-value calculating unit that calculates, based on the second temperature, a first control value to control the first heating unit, and a first control unit that controls the first heating unit with the first control value.

According to another aspect of the present invention, a heating control method that is applied to a heating control device including a first heating unit that heats a member, a second heating unit that heats the member, a first temperature sensing unit that senses first temperature of the member in a first position corresponding to the first heating unit, and a second temperature sensing unit that senses second temperature of the member in a second position corresponding to the second heating unit, includes calculating, based on the second temperature, a first control value to control the first heating unit, and controlling the first heating unit with the first control value.

According to still another aspect of the present invention, a computer program product includes a computer usable medium having computer readable program codes embodied in the medium that, when executed, cause a computer to implement the above method.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8 is a schematic for explaining an example in which the temperature of an edge is sensed when the center heater or the edge heater is turned on while paper with the maximum width is passing through;

FIG. 9 is a schematic for explaining an example in which the temperature of the edge is sensed when the center heater or the edge heater is turned on while paper with a small width is passing through;

FIG. 16 is a schematic for explaining an example in which the temperature of the center is sensed when the center heater or the edge heater is turned on while paper with the maximum width is passing through;

FIG. 18 is an example of contents of a table of correction equations for regular thick paper with a width more than 210 millimeters;

FIG. 19 is an example of contents of a table of correction equations for regular thick paper with a width equal to or smaller than 210 millimeters;

FIG. 20 is an example of contents of a table of correction equations for thick paper with a width more than 210 millimeters;

FIG. 21 is an example of contents of a table of correction equations for thick paper with a width equal to or smaller than 210 millimeters.

DETAILED DESCRIPTION OF THE PREFERRED EMBODIMENTS

Exemplary embodiments of the present invention are explained in detail below with reference to the accompanying drawings.

Figure 1:
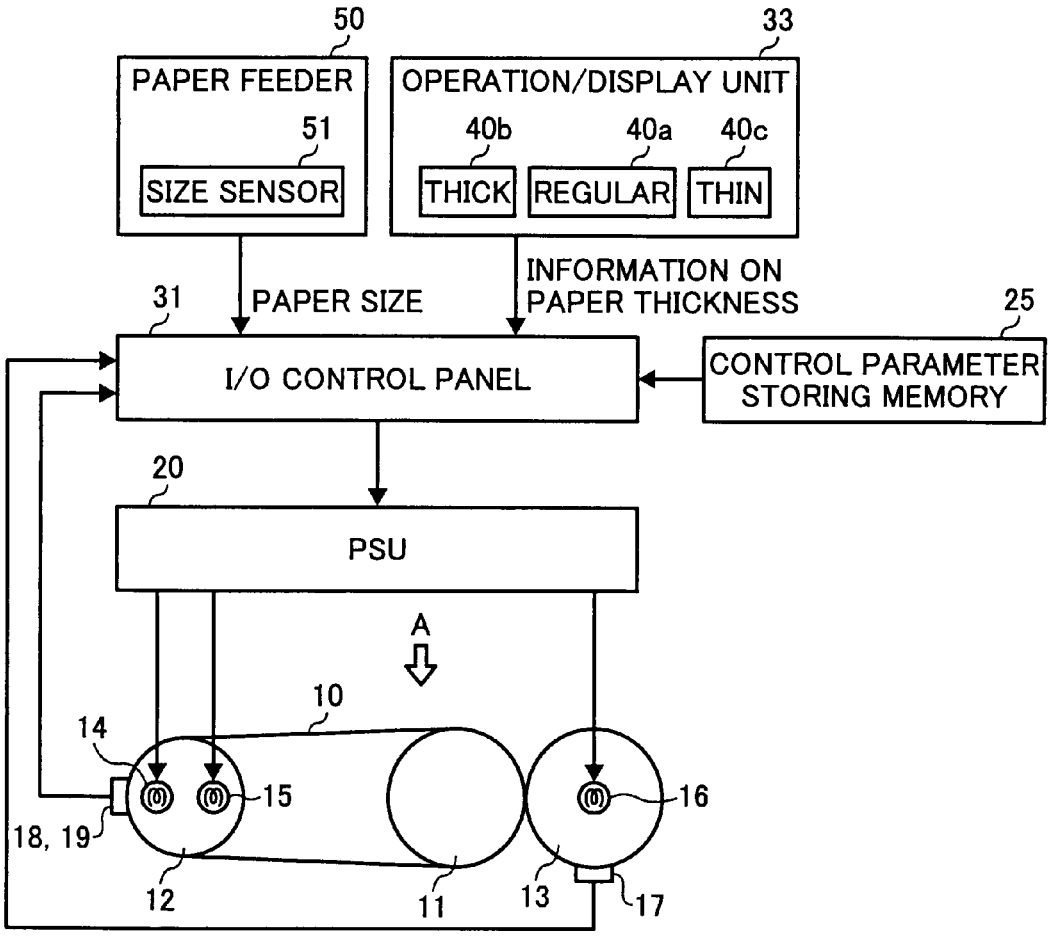
FIG. 1 is a block diagram of an example of a fixing device according to a first embodiment of the present invention.
Figure 2:
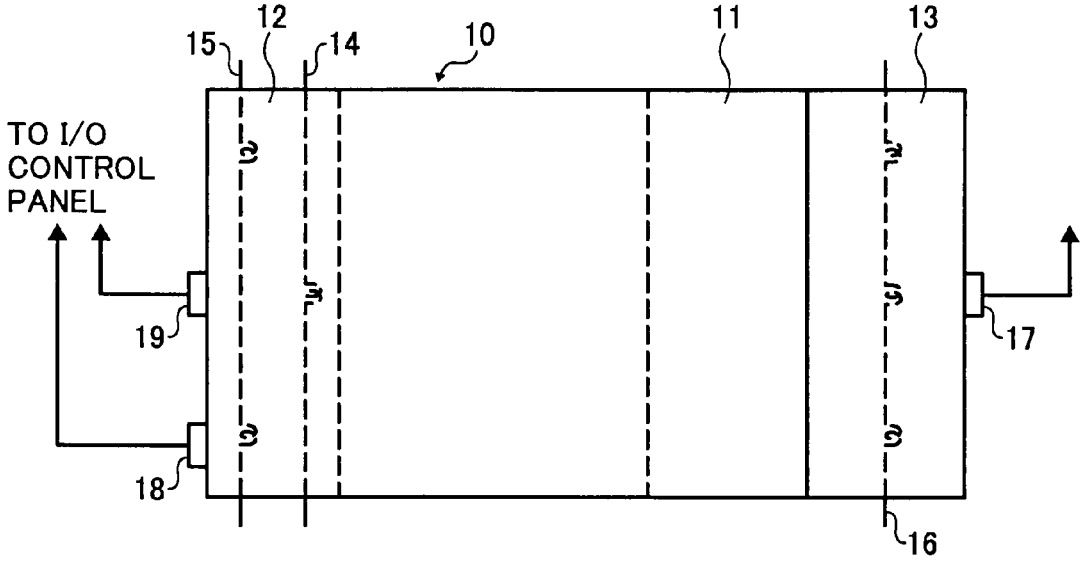
FIG. 2 is a schematic for explaining a positional relation between a fixing belt, a fixing roller, a heating roller, a pressure roller, halogen heaters, and temperature sensing elements viewed from a direction indicated by arrow A in FIG. 1.

FIG. 1 is a block diagram of an example of a fixing device according to a first embodiment of the present invention. FIG. 2 is a schematic for explaining a positional relation between a fixing belt 10, a fixing roller 11, a heating roller 12, a pressure roller 13, halogen heaters 14 to 16, and temperature sensing elements 17 to 19 viewed from a direction indicated by arrow A in FIG. 1. The fixing belt serves as a first rotating member. A control parameter storing memory 25 stores therein control data shown in FIGS. 18 to 21 and correction equations 1 to 14 (computing equations) described later. An input/output (I/O) control panel 31 controls turn-on of the halogen heaters via a power supply unit (PSU) 20 by PID control according to correction tables and correction equations described later. An operation/display unit 33 is used to input various parameters for settings, and displays information such as state of the device. A paper feeder 50 includes a paper feed tray or paper feed cassette that contains a stack of paper in a predetermined size, and feeds the paper.

In the description below and the drawings, to distinguish the halogen heaters 14 to 16 from one another, the halogen heater 14 in the heating center of the heating roller 12, the halogen heater 15 on the heating edge of the heating roller 12, and the halogen heater 16 in the pressure roller 13 are sometimes referred to as a center heater, an edge heater, and a pressure heater, respectively. Further, to distinguish the temperature sensing elements 17 to 19 from one another, they are sometimes referred to as a temperature sensing element (heating center), a temperature sensing element (heating edge), and a temperature sensing element (pressure), respectively.

The control parameter storing memory 25 in the first embodiment is further explained. The control parameter storing memory 25 stores therein correction equations for an edge heater turn-on rate that is a control value for the edge heater 15 added with a rate at which the heat transferred to the heating roller 12 by the halogen heater 14 in the heating center is transferred to the edge of the heating roller 12 and for a pressure heater turn-on rate that is a control value for the pressure heater 16. A rate of heat transferred that is used for a correction equation is determined for every kind of image forming apparatus. In other words, the rate varies depending on an amount of heat output by a halogen heater provided to an image forming apparatus, a material of the heating roller, and the like and is measured for every kind of apparatus and stored at the time of shipping and the like. In the first embodiment, correction equations when a paper width is "equal to or larger than 210 millimeters" and "smaller than 210 millimeters" are stored in the control parameter storing memory 25.

The operation/display unit 33 includes a key input for setting each kind of mode, a light emitting diode (LED), a liquid crystal display (LCD), and a display unit using a touch panel and the like and controlled by a system control panel 30 (see FIG. 30). In addition, the operation/display unit 33 particularly includes touch keys and the like, which include thickness setting keys 40*a*, 40*b*, and 40*c* for selecting a paper thickness. For example, when paper is thick such as a postcard, the thickness setting key 40*b* is pressed down. When paper is thinner than plain paper, the thickness setting key 40*c* is pressed down. The thickness setting key 40*a* is for plain paper, which is set by default without necessarily pressing down the key. Although paper thicknesses are designated by the thickness setting keys here, setting of paper thicknesses are not limited to this example. For a printer connected to a personal computer and the like, a paper thickness can be designated by application. Note that plain paper indicates paper commonly used in offices and thick paper indicates paper such as postcard, and 135K paper.

The paper feeder 50 includes a paper feed tray or a paper feed cassette loaded with a stack of paper in a predetermined size, and generally includes a size sensor 51 that is used in copiers and the like. For example, size recognition is realized by a well-known system such as an optical sensor corresponding to the side fence that sets a paper width, a lead switch type, and a micro switch. More specifically, it is realized by that, when a paper feed tray is used, a sensor system in which a paper size dial in a protrusion-depression form is provided in the tray portion, a plurality of switches opposite to the dial are provided on the main body side, the paper size dial is turned to set a predetermined size, and the protrusion corresponding to the protrusion-depression position of the dial presses down the switch on the main body side.

That is, the belt type fixing device includes the heating roller 12 and the fixing roller 11 that are wrapped around with the endless fixing belt 10. Further, the fixing device includes the pressure roller 13 that is a second rotating member arranged opposite to the fixing roller 11, the temperature sensing element (heating edge) 18 that senses a surface temperature of the heating roller 12 in the edge, the temperature sensing element (heating center) 19 that senses a temperature in the center thereof, and the temperature sensing element (pressure) 17 that senses a surface temperature of the pressure roller 13. In the structure, recording paper with toner thereon is passed through between the fixing roller 11 and the pressure roller 13, and the toner is fixed on the recording paper by the action of heat and pressure.

Figure 3:
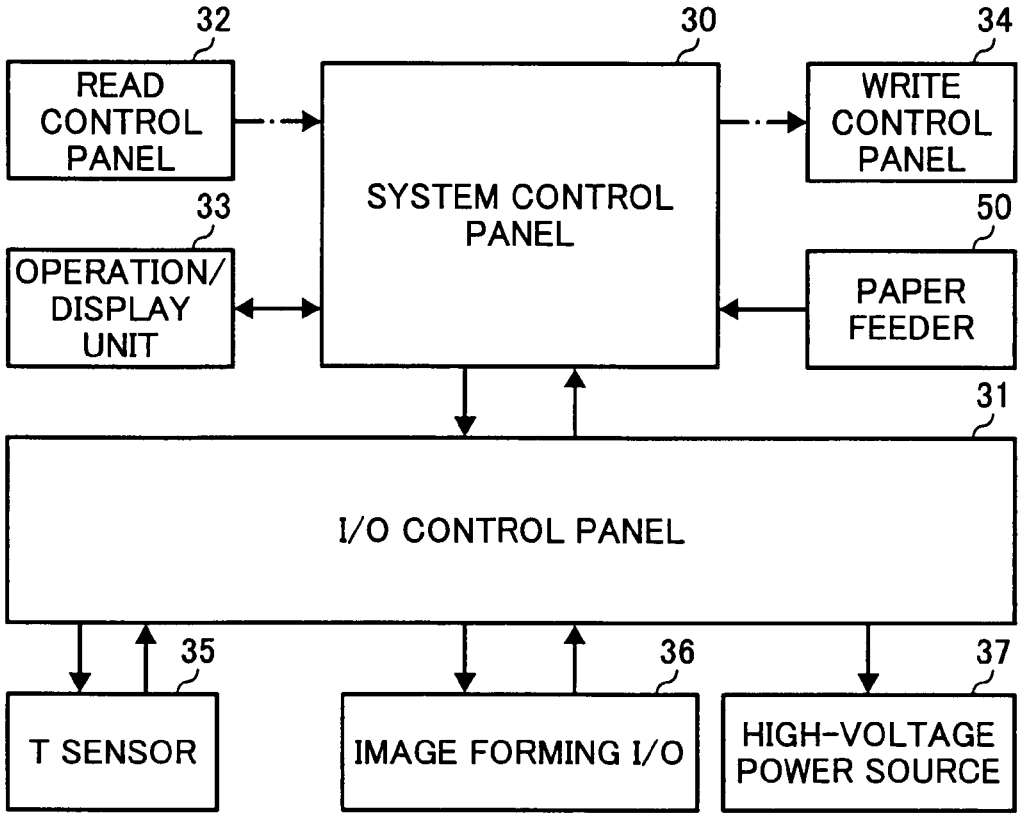
FIG. 3 is a block diagram of a control system of an image forming apparatus (digital copier) that includes the fixing device shown in FIG. 1.

FIG. 3 is a block diagram of a control system of the image forming apparatus (digital copier) that includes the fixing device according to the first embodiment. The image forming apparatus includes the system control panel 30, the I/O control panel 31, a read control panel 32, the operation/display unit 33, a write control panel 34, a toner concentration (T) sensor 35, an image forming I/O 36, a high-voltage power source 37, and the paper feeder 50.

The main operation of the read control panel 32 is a charge coupled device (CCD) to read document information and timing generation thereof, and the read control panel 32 transfers outputs read out to the system control plate 30 as a digital signal. The system control panel 30 includes a central processing unit (CPU), a read only memory (ROM), a random access memory (RAM), a nonvolatile RAM, and a calendar function chip and performs timing control of the entire system, input and output control of the operation/display unit 33, interface (I/F) with other application (facsimile, printer, and scanner) units (not shown), operation control thereof, and entire system control that includes image processing of image information data (scaling, filter, gamma correction, and the like) and memory/accumulation control of image information data using image memory. The write control panel 34 comprises a laser diode (LD) for exposure and a driving unit thereof and performs writing according to image data from the system control panel 30. The I/O control panel 31 is an integrated portion for input signals from each kind of sensor, actuator, and the like of the entire system (scanner, printer), and output signals to a motor, a solenoid, a crutch, the high-voltage power source, and the like. Outputs from the toner sensor and outputs from each thermistor are input to an analog-to-digital converter (AD converter), and the system control parts control each kind of control according to the I/O data. The I/O data includes information on the presence or absence of paper on the paper feed tray and a manual bypass tray, size information, a resist sensor for transfer paper delivery, and the like.

Figure 4:
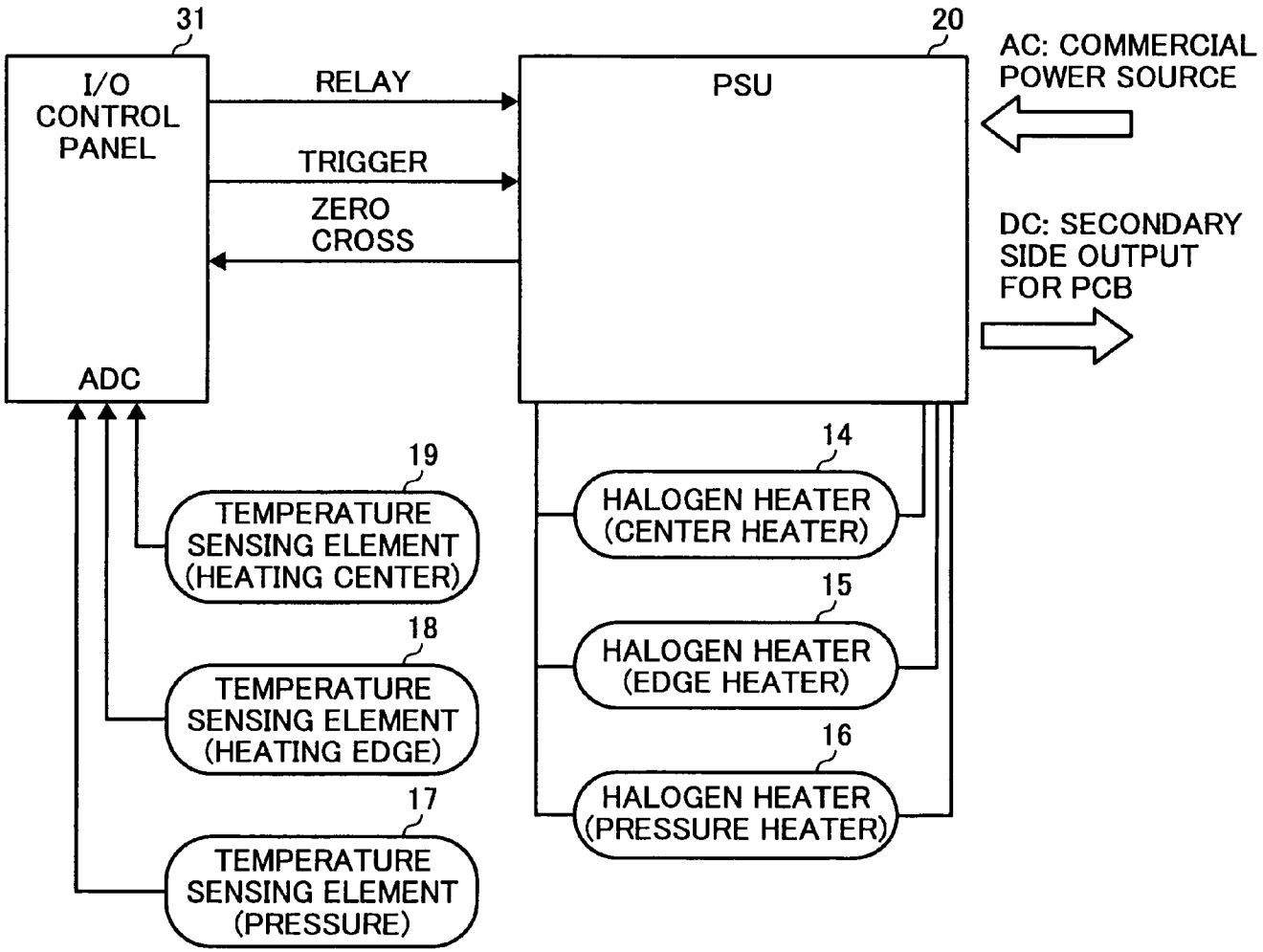
FIG. 4 is a schematic for explaining connections between the temperature sensing elements and the halogen heaters.

FIG. 4 is a schematic for explaining connections between the temperature sensing elements 17 to 19 and the halogen heaters 14 to 16 in the fixing device according to the first embodiment. The unit related to driving of the fixing heaters is explained with reference to FIG. 4. Here, an example in which halogen heaters are used for heat sources is explained. On the PSU 20, a circuit for power generation and a circuit for driving the halogen heaters for fixation are arranged. The heater driving includes a relay for alternated current (AC) power breaking, triacs that perform ON/OFF with a particular period, a snubber circuit, and the like.

Processing of ON/OFF of the relay and the triacs is performed according to the determination of the CPU (not shown) on the system control panel 30 via the ports on the I/O control panel 31. Each of the fixing heaters (halogen heaters 14 to 16) can be independently driven (ON/OFF) by each triac thereof. In the heating roller 12, there are two heaters. One is the center heater whose light distribution is close to the center of the heating roller 12 and the other is the edge heater whose light distribution is close to the edge thereof. One heater whose light distribution is flat is arranged in the pressure roller 13.

An example of control of the fixing device constructed as above is explained. To fix toner on recording paper, it is needed to keep the temperature of the fixing nip (contact portion between the fixing roller 11 and the pressure roller 13) necessary for toner fixation. To maintain the temperature of the fixing nip optimal, target temperatures T of the heating roller 12 and the pressure roller 13 are preset, respectively. The temperature sensing elements are arranged not only on the side of the heating roller 12 but also on the side of the pressure roller 13 in the belt type fixing device in FIG. 1. For the temperature sensing elements, thermistors are commonly used; however, the temperature sensing elements in the present invention are not limited to thermistors, and it is a matter of course that other temperature sensing elements in contact type and non-contact type can also be used. In the following embodiments, a paper thickness and a paper width are used for paper information. A target temperature of each temperature sensing element is set in advance: Ta for the center of the heating roller, Tb for the edge of the heating roller, and Tc for the pressure roller.

Figure 5:
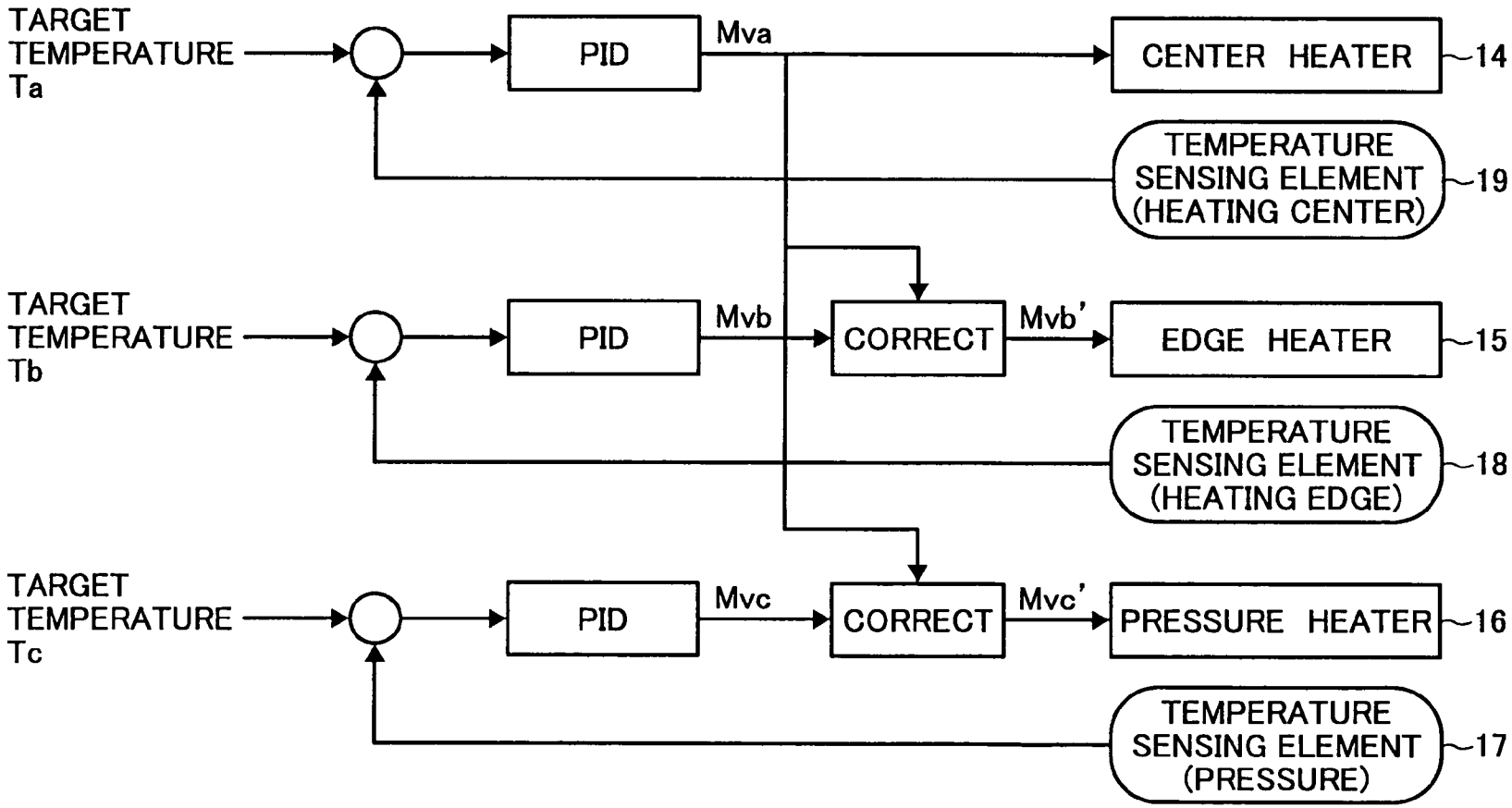
FIG. 5 is a block diagram of a fixing control unit according to the first embodiment.

FIG. 5 is a block diagram of a fixing control unit according to the first embodiment. Here, temperature sensed by each of the temperature sensing elements 17 to 19 is used, and a control amount Mv is obtained by PID from the difference from each target temperature. The procedure up to this is equivalent to that of the conventional control. With the use of each temperature sensed by each of the temperature sensing elements 17 to 19, heater turn-on rates (control amounts Mv) for the individual heat sources are obtained from the differences from the target temperatures, respectively, by PID.

Figure 6:
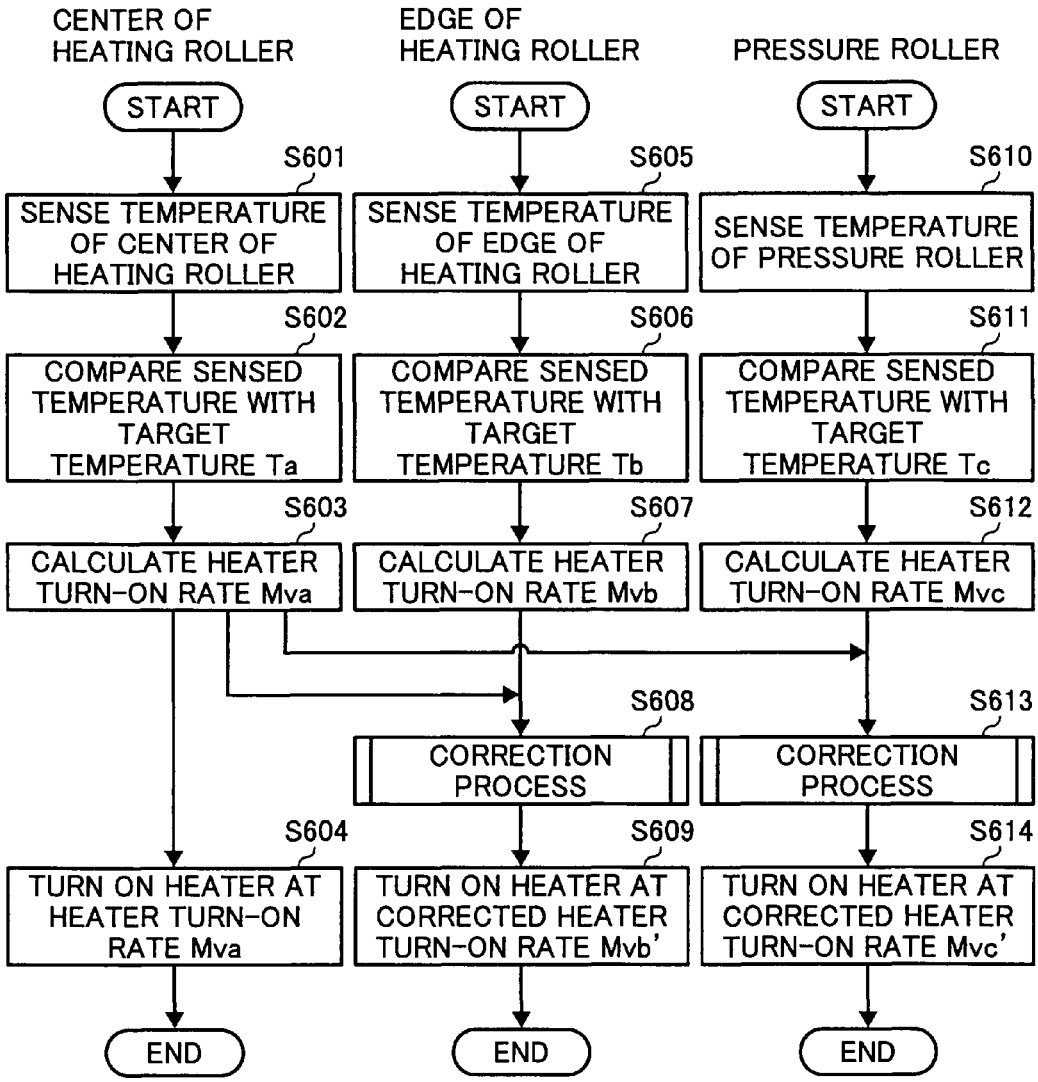
FIG. 6 is a flowchart of a heating control process performed by an I/O control panel shown in FIG. 1.

Next, a specific heating control process that varies for every paper width and paper thickness is explained. FIG. 6 is a flowchart of the heating control process performed by the I/O control panel 31. Note that the procedure shown in FIG. 6 is repeated every predetermined time, for example, every one second.

First, in the process for the center of the heating roller 12, the temperature sensing element (heating center) 19 senses the temperature of the center of the heating roller 12 (step S601). The I/O control panel 31 compares the target temperature Ta of the center of the heating roller 12 that has been preset with the sensed temperature (step S602). The I/O control panel 31 calculates a heater turn-on rate Mva for the center heater 14 from the comparison result between the target temperature Ta and the sensed temperature (step S603). The I/O control panel 31 turns on the center heater 14 at the heater turn-on rate Mva (step S604).

In the process for the edge of the heating roller 12, the temperature sensing element (heating edge) 18 senses the temperature of the edge of the heating roller 12 (step S605). The I/O control panel 31 compares the target temperature Tb of the edge of the heating roller 12 that has been preset with the sensed temperature (step S606). The I/O control panel 31 calculates a heater turn-on rate Mvb for the edge heater 15 from the comparison result between the target temperature Tb and the sensed temperature (step S607). The I/O control panel 31 corrects the heater turn-on rate Mvb with the use of the heater turn-on rate Mva for the center heater 14 (step S608). The details of the turn-on rate correction process are described later. The I/O control panel 31 turns on the edge heater 15 at a corrected heater turn-on rate Mvb' (step S609).

In the process for the pressure roller 13, the temperature sensing element (pressure) 17 senses the temperature of the pressure roller 13 (step S610). The I/O control panel 31 compares the target temperature Tc of the pressure roller 13 that has been preset with the sensed temperature (step S611). The I/O control panel 31 calculates a heater turn-on rate Mvc for the pressure heater 16 from the comparison result between the target temperature Tc and the sensed temperature (step S612). The I/O control panel 31 corrects the heater turn-on rate Mvc calculated with the use of the heater turn-on rate Mva for the center heater 14 (step S613). The details of the turn-on rate correction process are described later. The I/O control panel 31 turns on the pressure heater 16 at a corrected heater turn-on rate Mvc' (step S614).

In this manner, the edge heater and the pressure heater are turned on after taking into account amount of heat transferred from the center heater to the edge of the heating roller and the pressure roller by correcting the turn-on rates for the edge heater and the pressure heater respectively, in consideration of the turn-on rate for the center heater. Therefore, an amount of heat exceeding the amount required is not supplied to the edge of the heating roller and the pressure roller, and unnecessary power supply can be prevented.

Further, the turn-on rates for the edge heater and the pressure heater are corrected using not the temperature of the heating roller currently sensed (that is, not a turn-on rate at which the heater has already been controlled) but the turn-on rate at which the center heater is going to be controlled from now. Therefore, an amount of heat transferred from the center heater to the edge of the heating roller and the pressure roller can be taken into account without any time lag, and unnecessary heating can be prevented.

Figure 7:
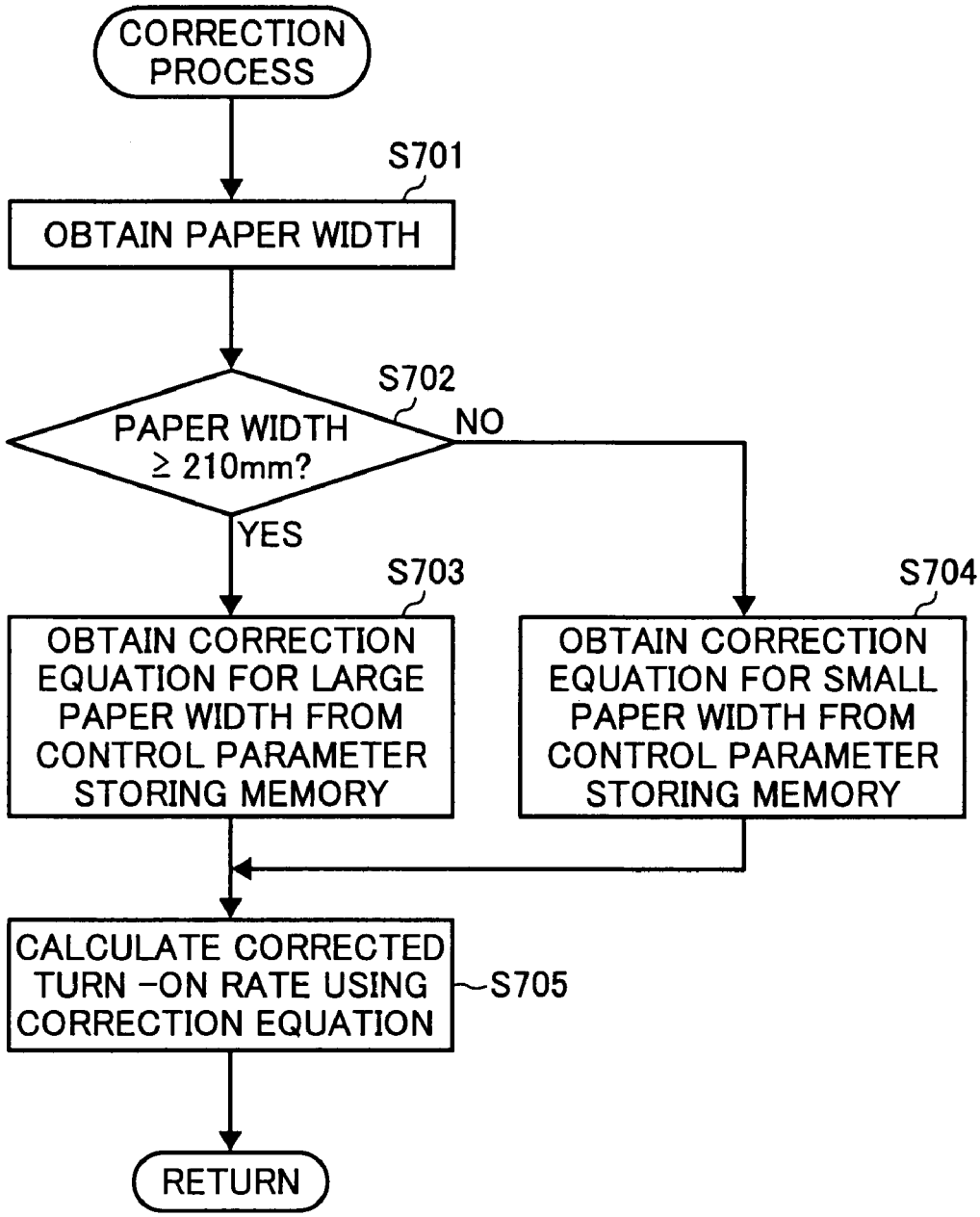
FIG. 7 is a detailed flowchart of a turn-on rate correction process for an edge heater and a pressure heater shown in FIG. 6.

FIG. 7 is a detailed flowchart of the turn-on rate correction process for each of the edge heater and the pressure heater shown in FIG. 6. Note that the process in FIG. 7 for each of the edge heater and the pressure heater is performed in the same manner except that only correction equations obtained from the control parameter storing memory 25 are different.

First, the size sensor 51 of the paper feeder 50 obtains a paper width (step S701). The I/O control panel 31 determines whether the paper width obtained is equal to or larger than 210 millimeters (step S702). When the paper width obtained is determined to be equal to or larger than 210 millimeters (Yes at step S702), the I/O control panel 31 obtains a correction equation for a large paper width from the control parameter storing memory 25 (step S703). When the paper width obtained is determined not to be equal to or larger than 210 millimeters, that is, smaller than 210 millimeters (No at step S702), the I/O control panel 31 obtains a correction equation for a small paper width from the control parameter storing memory 25 (step S704). The I/O control panel 31 calculates a correction turn-on rate that is corrected using the correction equation (hereinafter, "corrected turn-on rate") (step S705).

Next, correction equations for calculation of the corrected turn-on rate Mvb' for the edge heater and the corrected turn-on rate Mvc' for the pressure heater are further explained. First, correction equations for a paper width equal to or larger than 210 millimeters are explained. In the following explanation, common A4 size (210 millimeters×297 millimeters) paper is used as an example.

In the first embodiment, control amounts Mv are not used for control as they are but control amounts Mv for other heaters are corrected from the result of the heat source (heating center in the example) whose amount of heating is the largest. A value resulted from multiplying an amount of control Mva of the center heater 14 by a correction value 0.2 is subtracted from a control amount Mvb of the edge heater 15 (when the edge receives ca. 20 percent of the influence by turning on the center heater 14). Similarly when the pressure roller 13 receives ca. ten percent of the influence, a control amount Mvc of the pressure heater 16 is subtracted by that rate. The correction equations are as follows.

$$\text{Edge heater turn-on rate}(Mvb')=PID\ \text{calculated value}(Mvb)-\text{center heater turn-on rate}(Mva)\times 0.2$$

$$\text{Pressure heater turn-on rate}(Mvc')=PID\ \text{calculated value}(Mvc)-\text{center heater turn-on rate}(Mva)\times 0.1 \quad (1)$$

Here, a rate at which heat transferred to the heating roller 12 by the halogen heater 14 in the heating center used in the correction equation (1) is transferred to the edge of the heating roller 12 is explained. For example, in the equation (1), "0.2" is used as a rate of heat transfer. This is calculated as follows.

Figure 8:
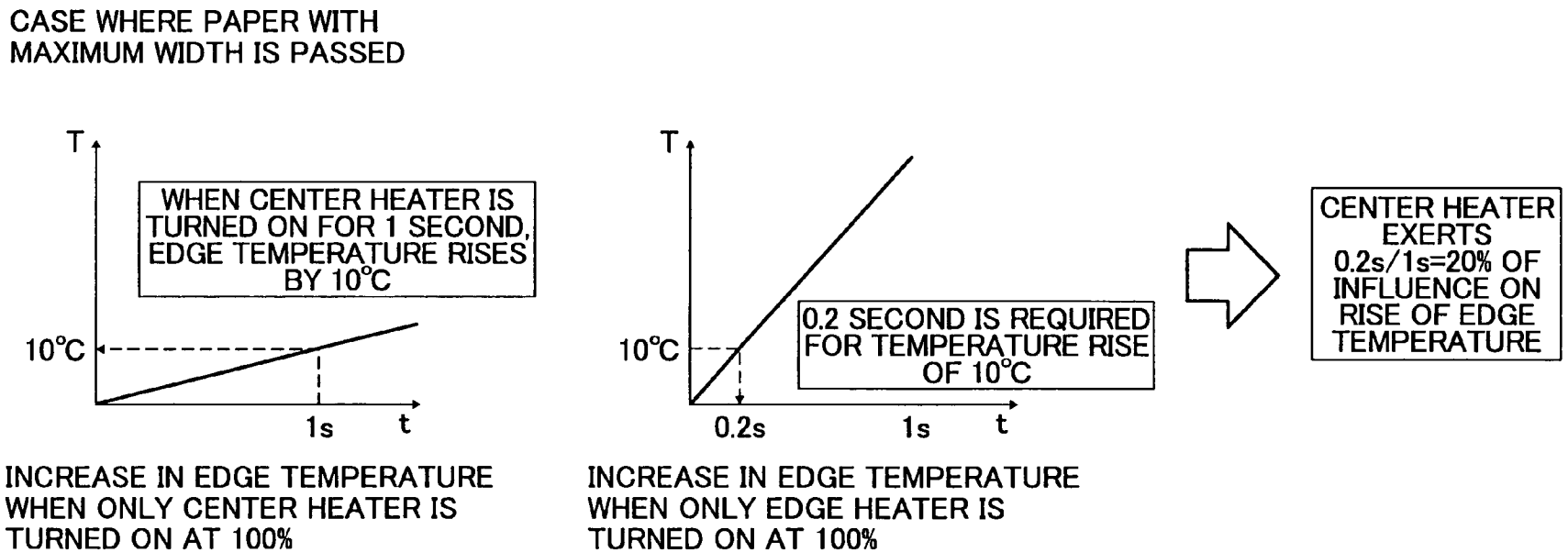

A method of calculating a rate of heat transferred from the center to the edge is explained. FIG. 8 is a schematic for explaining an example in which the temperature of an edge is sensed when the center heater or the edge heater is turned on while paper with the maximum width is passing through. The case of passing paper with the maximum width means that, for example, A4 size paper (210 millimeters×297 millimeters) is passed through such that the width perpendicular to the paper moving direction is 297 millimeters. Note that in respect of the width (length) parallel to the paper moving direction, a sufficient amount of heat is provided even if sheets of paper are passed through continuously. Therefore, shift of heat to the paper due to the difference in length is not taken into consideration.

As shown in FIG. 8, when only the center heater 14 is turned on at 100% for one second, the temperature of the edge of the heating roller 12 rises by 10° C. Further, to raise the temperature of the edge of the heating roller 12 by 10° C. by turning on only the edge heater 15 at 100%, the edge heater 15 is required to be ON for 0.2 second. From this, it is understood that the center heater 14 exerts 0.2 second/1 second=0.2, that is, 20% of the influence when the temperature of the edge of the heating roller 12 is raised.

Next, correction equations when a paper width is smaller than 210 millimeters are explained. When a paper size is small (narrow width), the paper is not passed through the edge of the fixing belt 10, and therefore heat is hardly drawn from the edge. Since the above equation is formulated assuming that fixation is performed for paper with the same width as that of the fixing belt 10, there is a fear that the temperature of the edge rises excessively when the equation is used as it is.

Accordingly, when a paper size is small (narrow width), the edge receives a large influence from the center heater 14. Therefore, the following equation in which the Mva is multiplied by a correction value of 0.3 is used here.

$$\text{Edge heater turn-on rate}(Mvb')=PID\ \text{calculated value}(Mvb)-\text{center heater turn-on rate}(Mva)\times 0.3$$

$$\text{Pressure heater turn-on rate}(Mvc')=PID\ \text{calculated value}(Mvc)-\text{center heater turn-on rate}(Mva)\times 0.1 \quad 2$$

Here, a rate at which heat transferred to the heating roller 12 by the halogen heater 14 in the heating center used in the correction equation (2) is transferred to the edge of the heating roller 12 is explained. For example, in the equation (2), "0.3" is used as a rate of heat transfer. This is calculated as follows.

Figure 9:
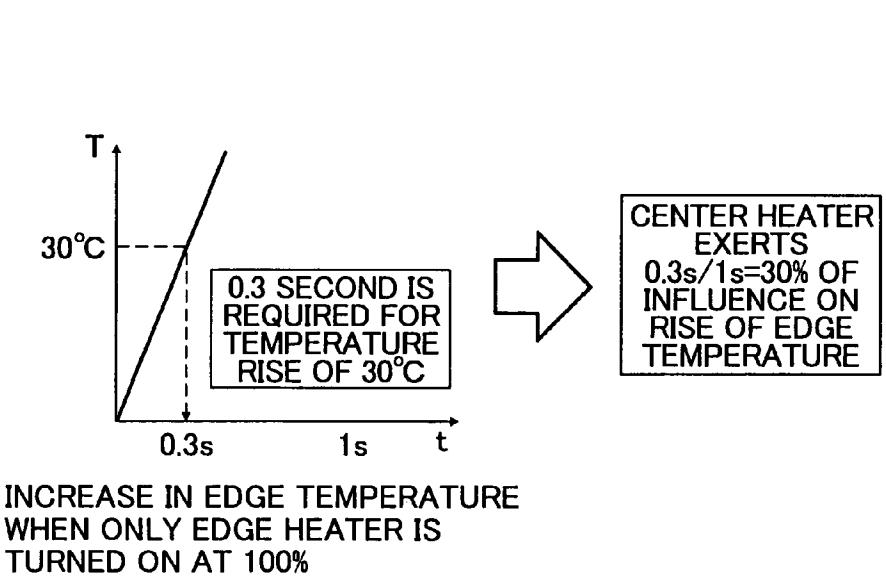

FIG. 9 is a schematic for explaining an example in which the temperature of the edge is sensed when the center heater or the edge heater is turned on while paper with a small width is passing through. As shown in FIG. 9, when only the center heater 14 is turned on at 100% for one second, the temperature of the edge of the heating roller 12 rises by 30° C. To raise the temperature of the edge of the heating roller 12 by 30° C. by turning on only the edge heater 15 at 100%, the edge heater 15 is required to be ON for 0.3 second. From this, it is understood that the center heater 14 exerts 0.3 second/1 second=0.3, that is, 30% of the influence when the temperature of the edge of the heating roller 12 is raised. Note that in the fixable range of temperature, a relation between turn-on time and sensed temperature is directly proportional as shown in FIGS. 8 and 9.

A narrow paper width indicates that, for example, a paper width is smaller than 210 millimeters (A4 vertical width). When a paper width is smaller than 210 millimeters, the equations 2 are used, and when a paper width is equal to or larger than 210 millimeters, the equations 1 are used.

In the first embodiment, the main heat source is the center heater 14; however, another heat source may be the main heat source, of course. Further, although a paper width at which correction values are changed is set to 210 millimeters and the respective correction values are set to 0.2 and 0.3, correction values are not limited to these.

As explained above, according to the first embodiment, amounts of heating for the first, the second, and the third heating units (halogen heaters 14 to 16) are calculated by PID based on temperatures sensed by the first, the second, and the third temperature sensing units (temperature sensing elements), and each heat source is controlled after correcting the calculated results according to a paper width. By taking a paper width into consideration in addition to an amount of heating of each heat source, not only can the temperatures of the fixing belt 10 (the first rotating member) and the pressure roller 13 (the second rotating member) be finely controlled but also an increase in temperature of the edge can be avoided. By performing such fine temperature control, power saving can be realized particularly when paper is in a small size.

In the first embodiment, turn-on rates for the edge heater and the pressure heater can also be calculated in consideration of a paper thickness as described later.

A belt type fixing device and an image forming apparatus and the like according to a second embodiment of the present invention are basically similar to those in the first embodiment, and the same explanation is not repeated. The equations 1 used in the first embodiment are correction equations in consideration of a case where a paper width is equal to or larger than the A4 width (297 millimeters) that is approximately the same width as that of the fixing belt 10. In the second embodiment, when a paper width is smaller than 297 millimeters, an amount of heat drawn varies depending on paper width, and therefore, the correction value is changed according to paper width. A correction equation in which a value resulted from dividing 297 millimeters by a paper width (unit in millimeters) is multiplied is used.

Figure 10:
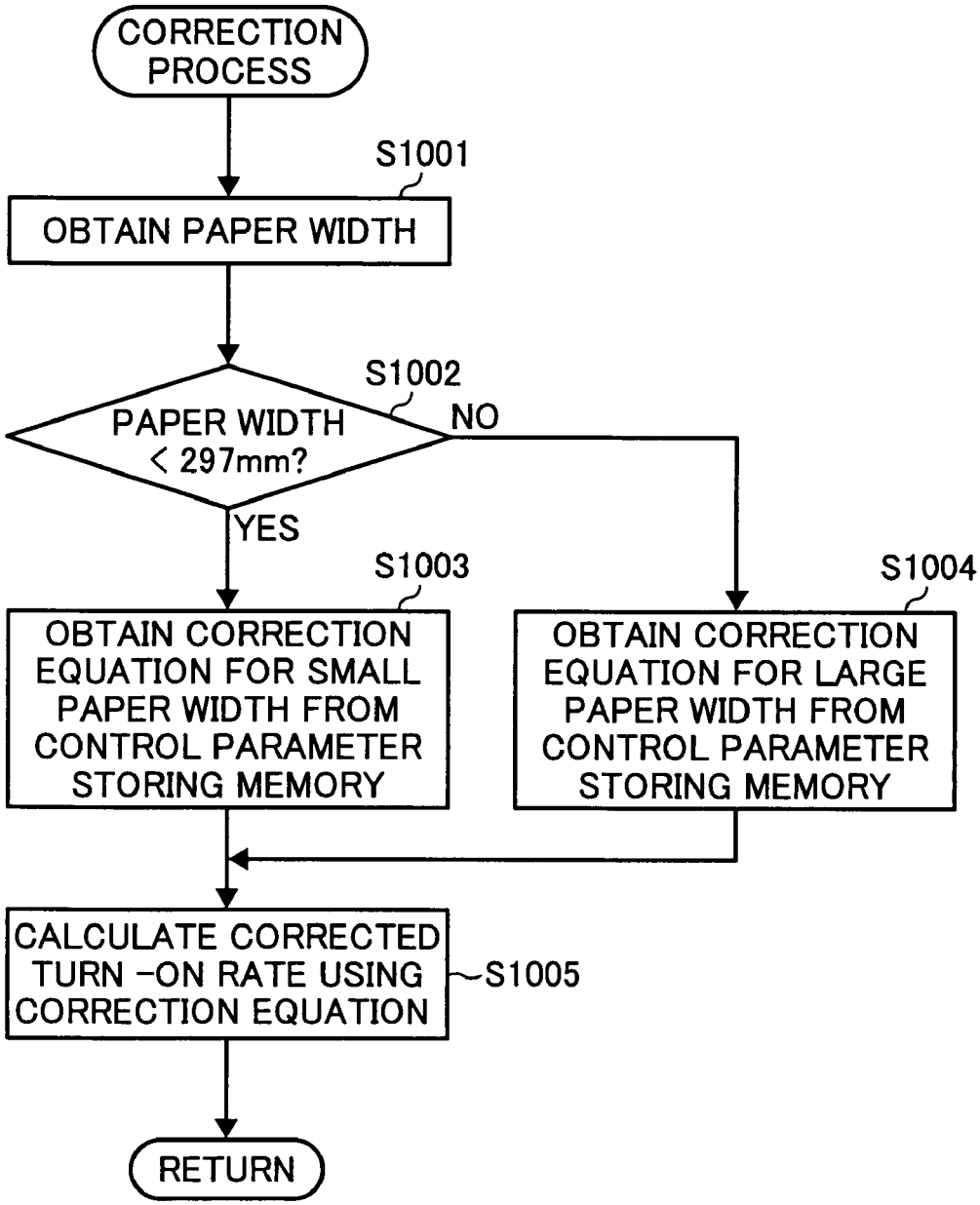
FIG. 10 is a detailed flowchart of another turn-on rate correction process for the edge heater and the pressure heater shown in FIG. 6.

The heating control process performed by the I/O control panel is the same as previously described in connection with FIG. 6, and the same explanation is not repeated. FIG. 10 is a detailed flowchart of another turn-on rate correction process for the edge heater and the pressure heater shown in FIG. 6.

First, the size sensor 51 of the paper feeder 50 obtains a paper width (step S1001). The I/O control panel 31 determines whether the paper width obtained is smaller than 297 millimeters (step S1002). When the paper width obtained is determined to be smaller than 297 millimeters (Yes at step S1002), the I/O control panel 31 obtains a correction equation for a small paper width from the control parameter storing memory 25 (step S1003). When the paper width obtained is determined to be equal to or larger than 297 millimeters (No at step S1002), the I/O control panel 31 obtains a correction equation for a large paper width from the control parameter storing memory 25 (step S1004). The I/O control panel 31 calculates a corrected turn-on rate using the correction equation (step S1005).

Next, correction equations for calculation of the corrected turn-on rate Mvb' for the edge heater and the corrected turn-on rate Mvc' for the pressure heater are further explained. First, correction equations for a paper width equal to or larger than 297 millimeters are the same as the equations 1. On the other hand, equations for a paper width smaller than 297 millimeters are as follows.

$$\text{Edge heater turn-on rate}(Mvb')=PID\ \text{calculated value}(Mvb)-\text{center heater turn-on rate}(Mva)\times 0.2\times(297/\text{paper width})$$

$$\text{Pressure heater turn-on rate}(Mvc')=PID\ \text{calculated value}(Mvc)-\text{center heater turn-on rate}(Mva)\times 0.1 \quad 3$$

Although the edge heater turn-on rate (Mvb') is obtained by the equation 3 in which the correction value 0.2 is simply multiplied by a rate of the width difference, a correction equation is not limited to the equation.

Since only two correction equations are switched depending on paper width in the first embodiment, a problem sometimes arises in temperature control when a paper width is in the middle of them. By virtue of correcting a correction value by calculation depending on paper width in the second embodiment of the present invention, not only can the temperatures of the fixing belt 10 (the first rotating member) and the pressure roller 13 (the second rotating member) be finely controlled for all paper widths but also an increase in temperature of the edge can be avoided.

Figure 11:
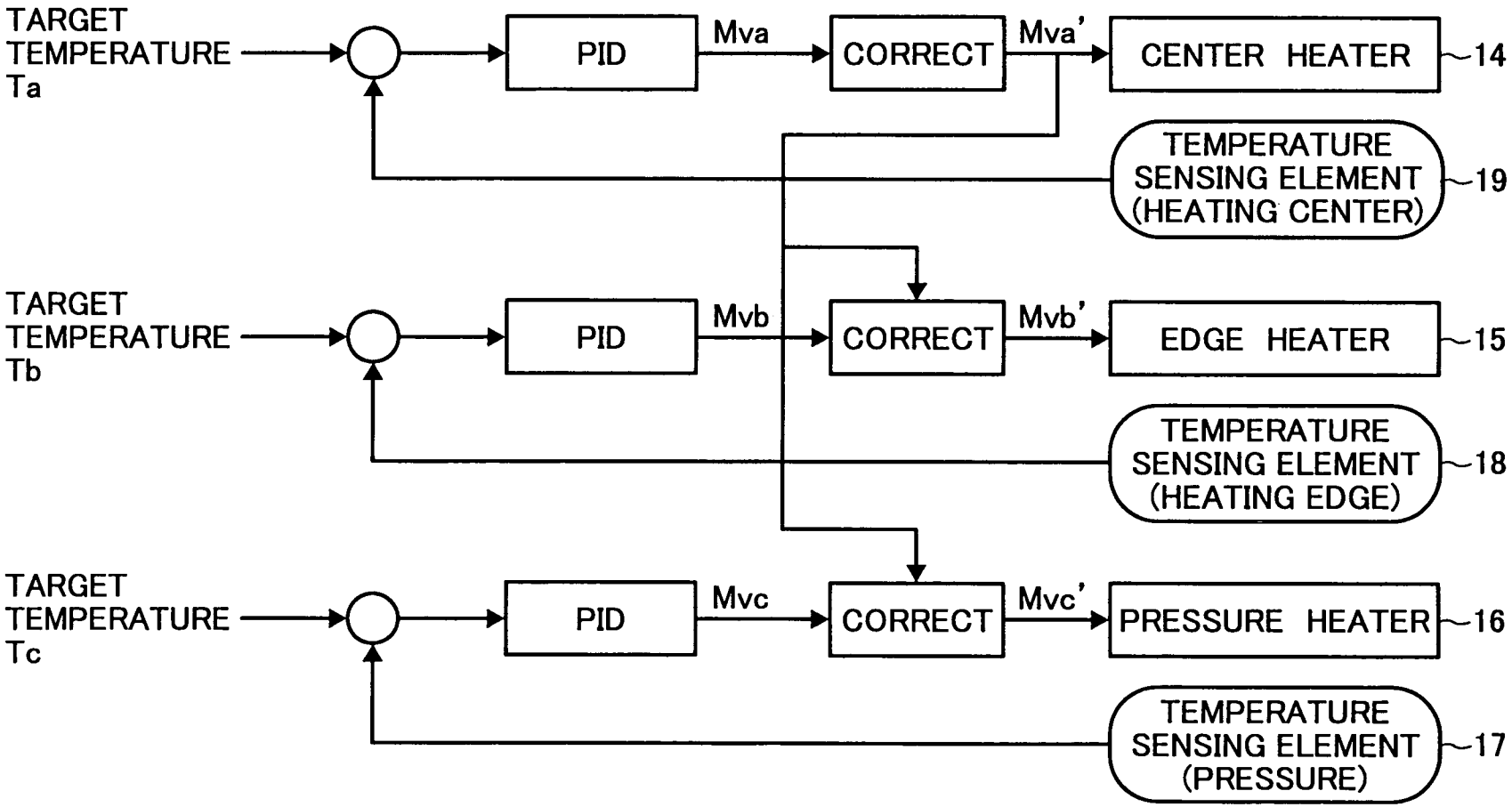
FIG. 11 is a block diagram of a fixing control unit according to a third embodiment of the present invention.

A belt type fixing device and an image forming apparatus according to a third embodiment of the present invention are basically similar to those in the first embodiment, but one aspect in which correction is added in respect of the turn-on rate Mva for the center heater 14 is different. FIG. 11 is a block diagram of a fixing control unit according to the third embodiment.

Figure 12:
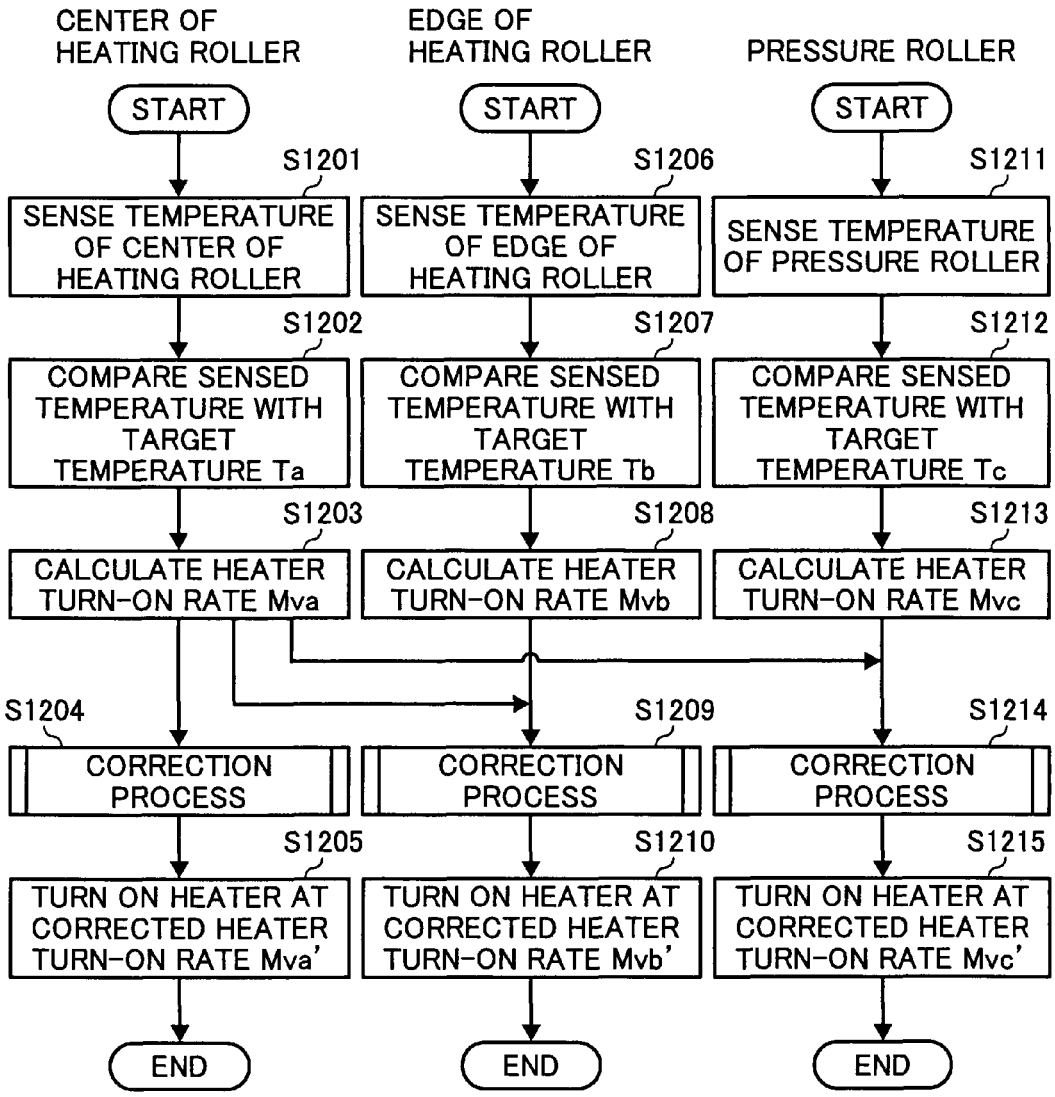
FIG. 12 is a flowchart of a heating control process according to the third embodiment.

A heating control process for the center heater, the edge heater, and the pressure heater is explained. FIG. 12 is a flowchart of the heating control process performed by the I/O control panel. Note that the heating control process according to the third embodiment is in many respects the same as previously described in connection with FIG. 6. Therefore, only different part is explained. The process at steps S1201 to S1203 and steps S1206 to S1215 is the same as that in FIG. 6, and the same explanation is not repeated.

At step S1203, after a turn-on rate Mva for the center heater 14 is calculated, the I/O control panel 31 performs a correction process (step S1204). The details of the turn-on rate correction process are described later. The I/O control panel 31 turns on the center heater 14 at the corrected turn-on rate Mva' calculated in the correction process (step S1205).

Figures 13, 13A:
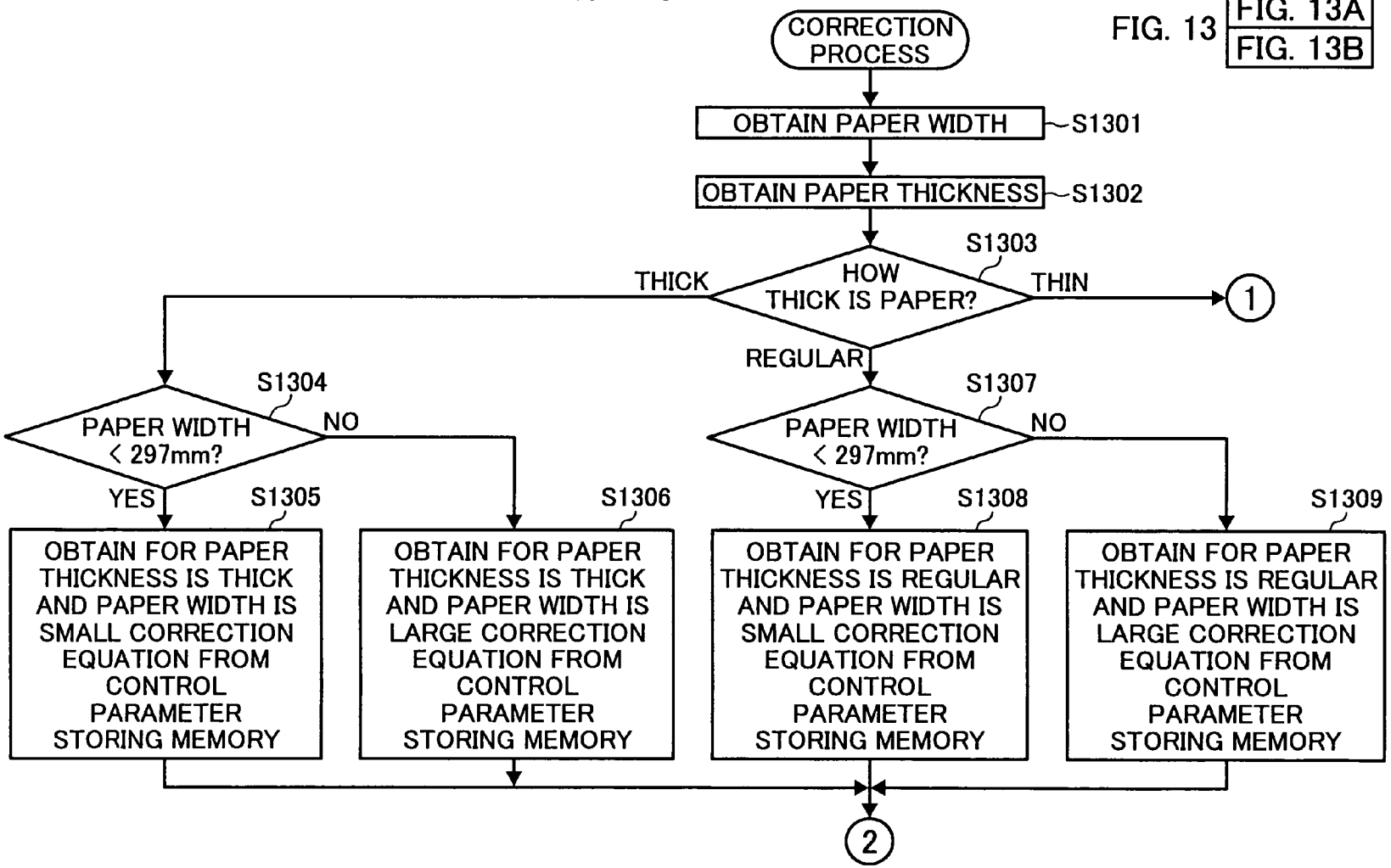
FIG. 13 is a detailed flowchart of a turn-on rate correction process shown in FIG. 12.
Figure 13B:
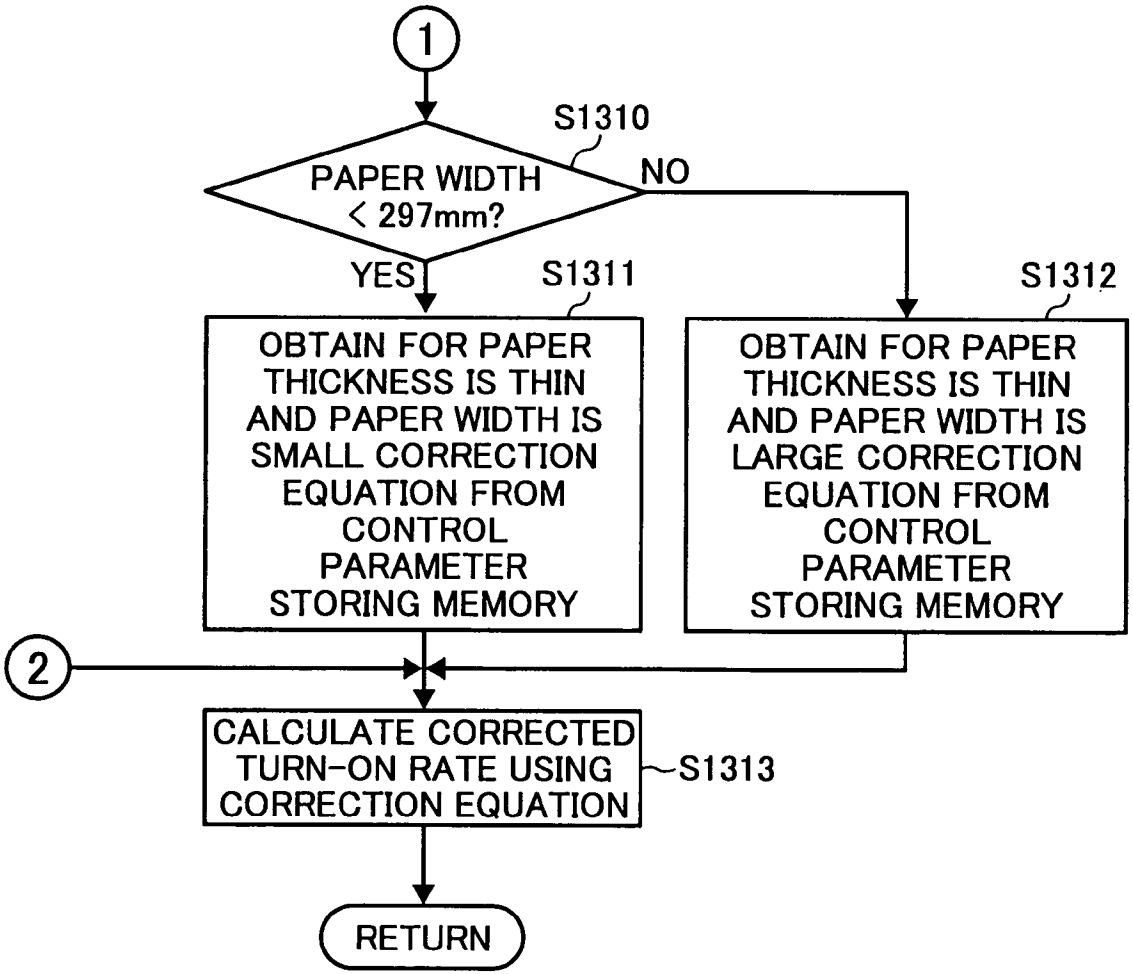

FIG. 13 is a detailed flowchart of the turn-on rate correction process shown in FIG. 12. Note that the process in FIG. 13 performed for each of the center heater, the edge heater, and the pressure heater is performed in the same manner except that only correction equations obtained from the control parameter storing memory 25 are different.

First, the size sensor 51 of the paper feeder 50 obtains a paper width (step S1301). The operation/display unit 33 obtains a paper thickness by pressing down any one of the buttons of "THICK", "REGULAR", and "THIN" (step S1302). The I/O control panel 31 determines how thick the paper thickness is from "THICK", "REGULAR", and "THIN" (step S1303). When the paper thickness is determined to be "THICK" (THICK at step S1303), the I/O control panel 31 determines whether the paper width obtained is smaller than 297 millimeters (step S1304). When the paper width obtained is determined to be smaller than 297 millimeters (Yes at step S1304), the I/O control panel 31 obtains, from the control parameter storing memory 25, a correction equation for the case where a paper thickness is "THICK" and a paper width is small (step S1305). When the paper width obtained is determined not to be smaller than 297 millimeters, that is, equal to or larger than 297 millimeters (No at step S1304), the I/O control panel 31 obtains, from the control parameter storing memory 25, a correction equation for the case where a paper thickness is "THICK" and a paper width is large (step S1306).

At the step S1303, when the paper thickness is determined to be "REGULAR" (REGULAR at step S1303), the I/O control panel 31 determines whether the paper width obtained is smaller than 297 millimeters (step S1307). When the paper width obtained is determined to be smaller than 297 millimeters (Yes at step S1307), the I/O control panel 31 obtains, from the control parameter storing memory 25, a correction equation for the case where a paper thickness is "REGULAR" and a paper width is small (step S1308). When the paper width obtained is determined not to be smaller than 297 millimeters, that is, equal to or larger than 297 millimeters (No at step S1307), the I/O control panel 31 obtains, from the control parameter storing memory 25, a correction equation for the case where a paper thickness is "REGULAR" and a paper width is large (step S1309).

At the step S1303, when the paper thickness is determined to be "THIN" (THIN at step S1303), the I/O control panel 31 determines whether the paper width obtained is smaller than 297 millimeters (step S1310). When the paper width obtained is determined to be smaller than 297 millimeters (Yes at step S1310), the I/O control panel 31 obtains, from the control parameter storing memory 25, a correction equation for the case where a paper thickness is "THIN" and a paper width is small (step S1311). When the paper width obtained is determined not to be smaller than 297 millimeters, that is, equal to or larger than 297 millimeters (No at step S1310), the I/O control panel 31 obtains, from the control parameter storing memory 25, a correction equation for the case where a paper thickness is "THIN" and a paper width is large (step S1312). The I/O control panel 31 calculates a corrected turn-on rate with the use of the obtained correction equation (step S1313).

Next, an example of correction equation stored in the control parameter storing memory is explained. When a paper thickness is "THICK" and a paper width is large, equations 4 shown below are used. When paper is thick, an amount of heat drawn is larger compared to that when paper has a regular thickness, which sometimes results in a decrease in temperature when the equations 1 are used. Accordingly, in a case of thick paper, the equations 4 are used. An example in which an amount of heat is increased more than that for plain paper is explained.

$$\text{Center heater turn-on rate}(Mva')=PID\ \text{calculated value}\ (Mva)\times 1.1$$

$$\text{Edge heater turn-on rate}(Mvb')=PID\ \text{calculated value}\ (Mvb)\times 1.1-\text{center heater turn-on rate}(Mva')\times 0.2$$

$$\text{Pressure heater turn-on rate}(Mvc')=PID\ \text{calculated value}(Mvc)-\text{center heater turn-on rate}(Mva')\times 0.1 \qquad 4$$

In the equations 4, the amounts of turn-on of the center heater 14 and the edge heater 15 are multiplied by 1.1, respectively; however, correction values and correction equations are not limited to these. Further, only thick paper is used as an example, but the correction amount can also be changed, of course, to a plurality of correction amounts by multiplying, for example, 1.05-fold, 1.1-fold, and 1.2-fold depending on paper thickness.

Furthermore, when a paper thickness is "THICK" and a paper width is small, equations 5 shown below are used. When paper is thick and the paper width is small, it is necessary to avoid an increase in temperature of the edge as well as make small a decrease in temperature of the area where the paper is passed. Because of this, when paper is thick and a paper width is small, the following equations are used.

$$\text{Center heater turn-on rate}(Mva')=PID\ \text{calculated value}\ (Mva)\times 1.1$$

$$\text{Edge heater turn-on rate}(Mvb')=PID\ \text{calculated value}\ (Mvb)-\text{center heater turn-on rate}(Mva')\times 0.2\times(297/\text{paper width})$$

$$\text{Pressure heater turn-on rate}(Mvc')=PID\ \text{calculated value}(Mvc)-\text{center heater turn-on rate}(Mva')\times 0.1 \qquad 5$$

In the equations 5, only the amount of turn-on of the center heater 14 is multiplied by 1.1; however, a correction value and a correction equation are not limited to those.

When a paper thickness is "REGULAR" and a paper width is large, the equations 1 in the first embodiment described above are used. Note that in the case, no correction for the center heater 14 is performed and the center heater 14 is turned on at the turn-on rate Mva.

In this manner, it is possible to finely control the temperatures of the fixing belt 10 (the first rotating member) and the pressure roller 13 (the second rotating member) by correcting the turn-on rate for the center heater in addition to correction of the turn-on rates for the edge heater and the pressure heater using factors to draw heat such as a paper thickness and a paper width as conditions. Accordingly, heat supply can be performed without wasting.

In a fourth embodiment of the present invention, an influence exerted by the center heater 14 on the edge as well as an influence exerted by the edge heater 15 on the center are taken into consideration, and control amounts of the center heater and the edge heater are obtained, respectively.

Figure 14:
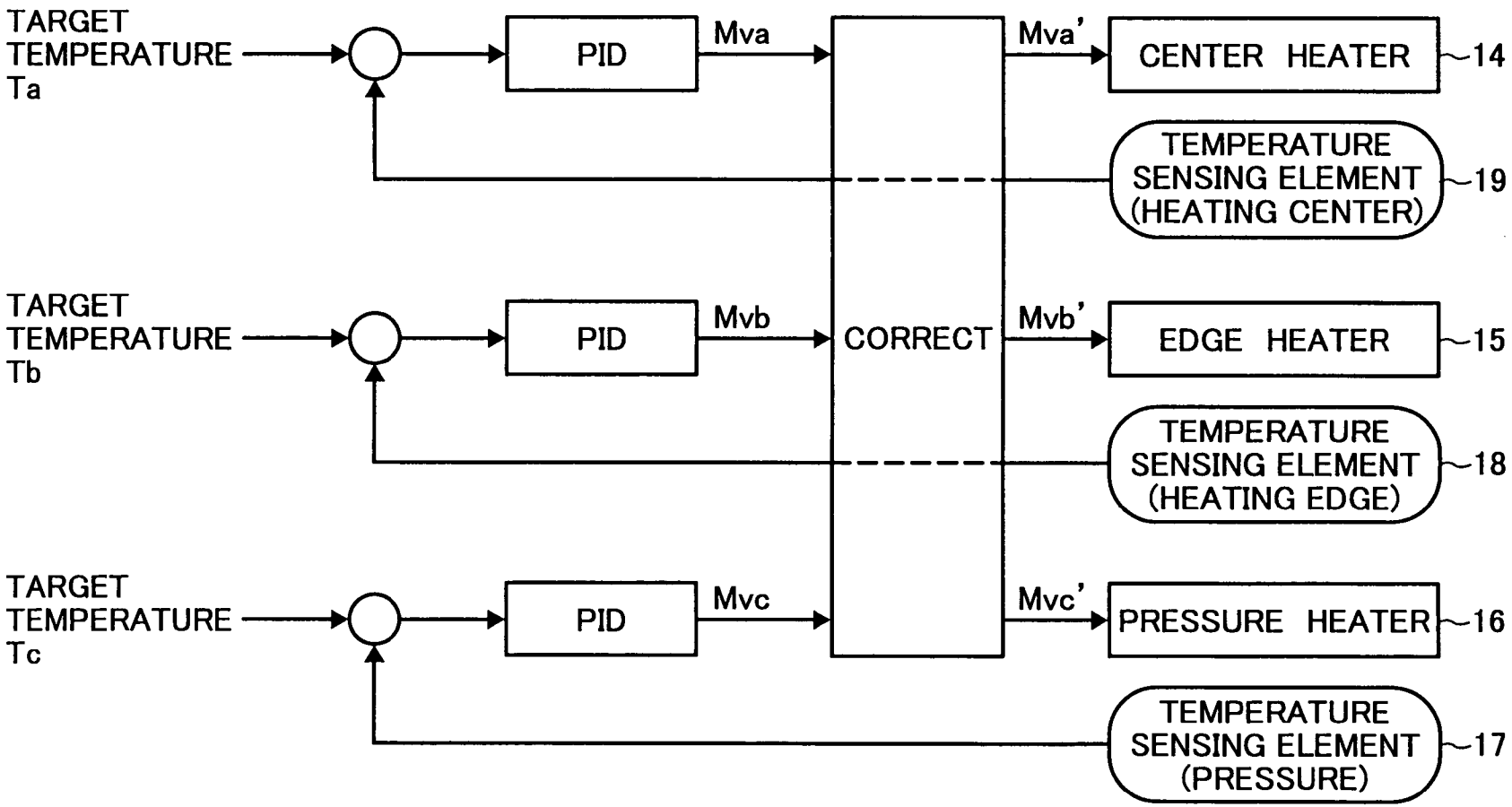
FIG. 14 is a block diagram of a fixing control unit according to a fourth embodiment of the present invention.

FIG. 14 is a block diagram of a fixing control unit according to the fourth embodiment. As shown in FIG. 14, correction is performed by calculating corrected turn-on rates Mva', Mvb', and Mvc' with the use of the turn-on control amounts Mva, Mvb, and Mvc calculated from the respective sensed temperatures, and the heaters are turned on according to the corrected turn-on rates Mva', Mvb', and Mvc', respectively.

Figure 15:
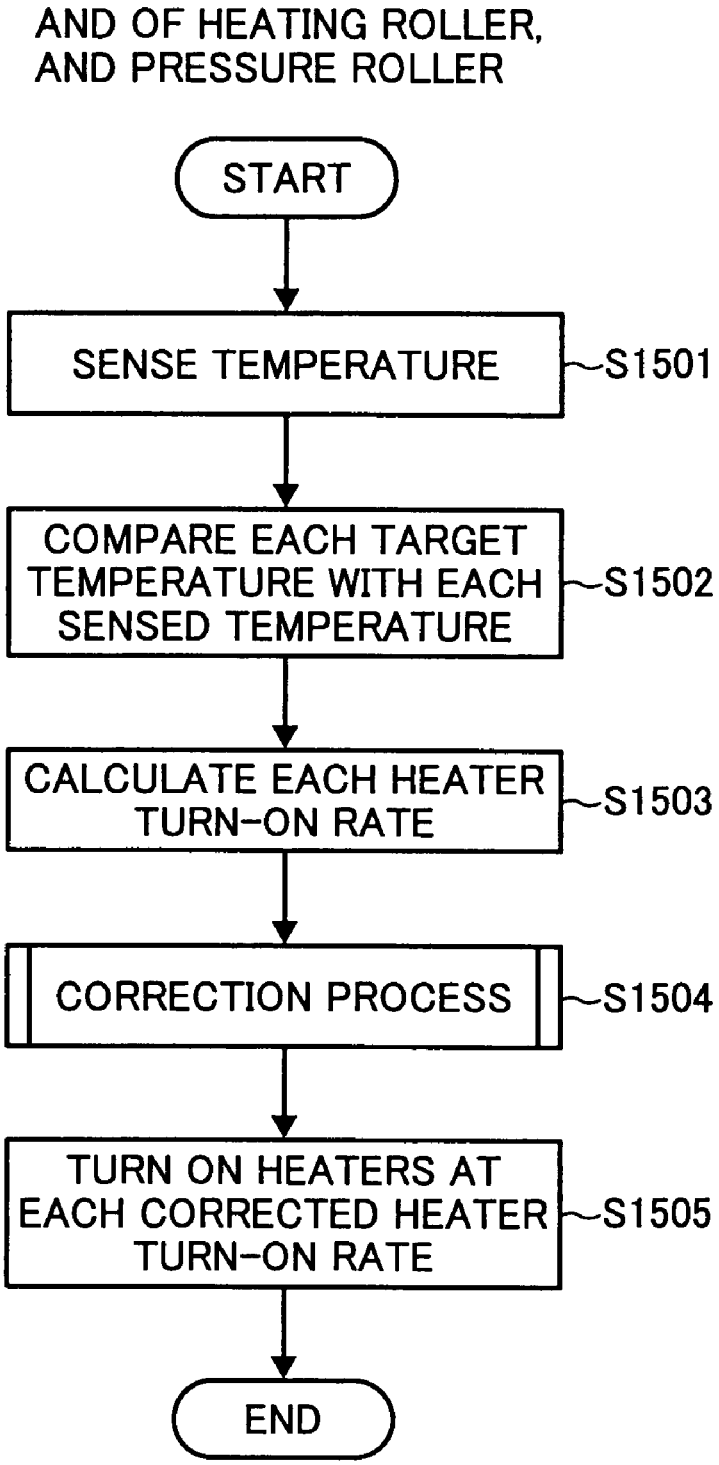
FIG. 15 is a flowchart of a heating control process according to the fourth embodiment.

FIG. 15 is a flowchart of a heating control process performed by the I/O control panel 31 according to the fourth embodiment.

First, the temperature sensing elements 17, 18, and 19 sense the temperatures of the pressure roller, the edge and center of the heating roller, respectively (step S1501). The I/O control panel 31 compares the target temperatures that have been preset with the sensed temperatures, respectively (step S1502). The I/O control panel 31 calculates each heater turn-on rate from each comparison result between the target temperature and the sensed temperature (step S1503). The I/O control panel 31 calculates corrected turn-on rates using the respective heater turn-on rates Mva, Mvb, and Mvc calculated (step S1504). The process is the same as that in FIG. 13 described above, and the same explanation is not repeated. The I/O control panel 31 turns on the heaters at the respective corrected turn-on rates Mva', Mvb', and Mvc'calculated (S1505).

Here, correction equations to calculate corrected turn-on rates and a method of obtaining the correction equations are explained. Note that an influence exerted by the center heater 14 on the edge is expressed by a coefficient A, and an influence exerted by the edge heater 15 on the center is expressed by a coefficient B. First, correction equations when a paper width is the same size (297 millimeters) as that of the fixing belt 10 and the paper has a regular thickness are explained. Since an influence exerted by the pressure heater 16 is very small, it is not taken into consideration.

Control amounts Mva and Mvb of heating center and heating edge obtained by PID are expressed by practical control amounts Mva' and Mvb' as follows.

$$Mva=Mva'+Mvb'\times B$$

$$Mvb=Mvb'+Mva'\times A \qquad 6$$

When the above equations are developed, they become as follows, and the practical control amounts can be obtained.

$$Mva'=(Mva-Mvb\times B)/(1-A\times B)$$

$$Mvb'=(Mvb-Mva\times A)/(1-A\times B) \qquad 7$$

When an influence exerted by the heating roller 12 on the pressure roller 13 is expressed by a coefficient C, a practical control amount can be obtained by the equation below.

$$Mvc'=Mvc-(Mva'+Mvb')\times C \qquad 8$$

Figure 16:
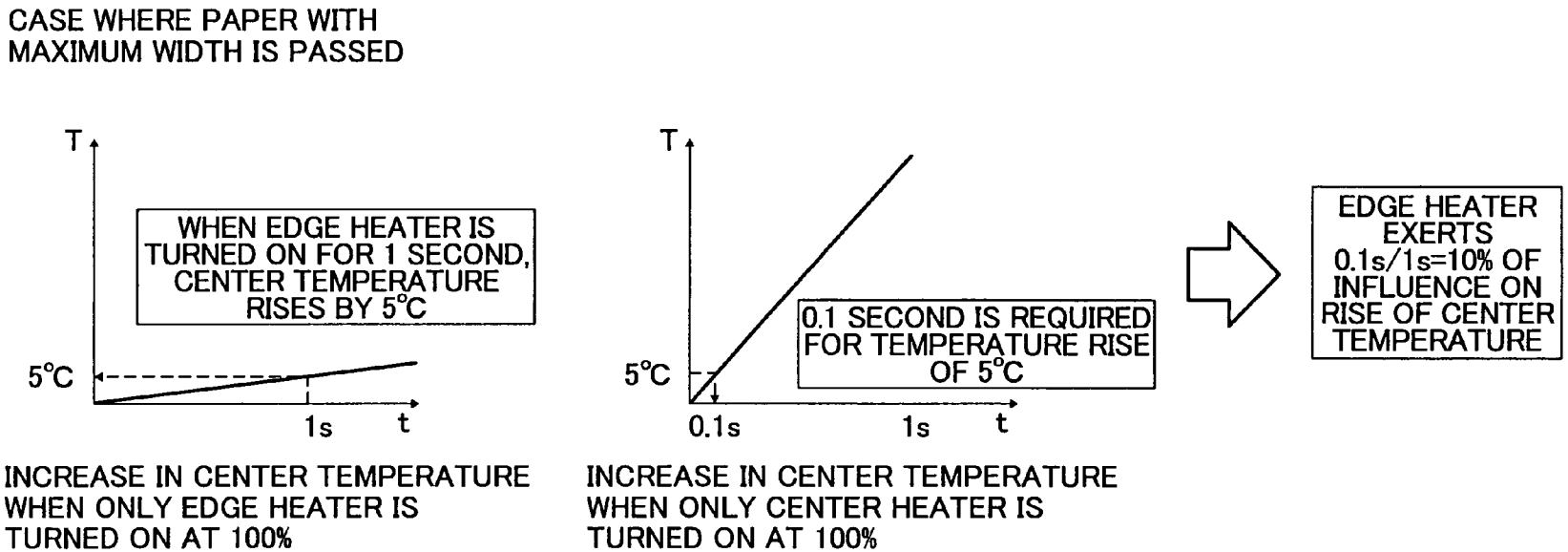

Here, a method of calculating a rate of heat transferred from the edge to the center is explained. FIG. 16 is a schematic for explaining an example in which the temperature of the center is sensed when the center heater or the edge heater is turned on while paper with the maximum width is passing through.

As shown in FIG. 16, when only the edge heater 15 is turned on at 100% for one second, the temperature of the center of the heating roller 12 rises by 5° C. To raise the temperature of the center of the heating roller 12 by 5° C. by turning on only the center heater 14 at 100%, the center heater 14 is required to be ON for 0.1 second. From this, it is understood that the edge heater 15 exerts 0.1 second/1 second=0.1, that is, 10% of the influence when the temperature of the center of the heating roller 12 is raised.

Next, correction equations when a paper width is smaller than the width of the fixing belt 10 (297 millimeters) and the paper has a regular thickness are explained. Since the above equation is formulated assuming that fixation is performed for paper with the same width (297 millimeters) as that of the fixing belt 10, there is a fear that the temperature of the edge rises excessively when the equation is used as it is. Accordingly, when a paper width is smaller than 297 millimeters, an amount of heat drawn varies depending on paper width. Therefore, the correction value is changed according to paper width. The equation below in which the correction equation is multiplied by a value resulted from dividing 297 millimeters by a paper width (unit in millimeters) is used. When a rate of heat transferred from the edge to the center is as shown in FIG. 16, a value of the coefficient B is equivalent to 0.1. When a rate of heat transferred from the center to the edge is as shown in FIG. 8, a value of the coefficient A is equivalent to 0.2.

$$Mva=Mva'a+Mvb'\times B$$

$$Mvb=Mvb'+Mva'\times A\times(297/\text{paper width}) \qquad 9$$

When the above equations are developed, they become as follows and practical control amounts can be obtained.

$$Mva'=(Mva-Mvb\times B)/(1-A\times(297/\text{paper width})\times B)$$

$$Mvb'=(Mvb-Mva\times A\times(297/\text{paper width}))/(1A\times(297/\text{paper width})\times B) \qquad 10$$

The equation 8 is used as it is as a correction equation for the pressure roller 13. Of course, the heat sources are not limited to the combination described above. Further, it is a matter of course that equations can also be formulated by taking the influences of the three heat sources into consideration, respectively.

In this manner, control amounts obtained by PID control are not used as they are but control amounts are determined using correction equations in consideration of heating amounts of other heat sources. By adding correction depending on paper width to correction equations, not only can the temperatures of the fixing belt 10 (the first rotating member) and the pressure roller 13 (the second rotating member) be finely controlled but also an increase in temperature of the edges of the rotating members can be avoided.

Further, correction equations for a case where a paper width is the same size (297 millimeters) as that of the fixing belt 10 and a paper thickness is large are explained. The equations 6 and 7 are for a regular paper thickness. When paper is thick, an amount of heat drawn becomes larger compared to that of paper with a regular thickness, which sometimes results in a decrease in temperature.

Accordingly, for a thick paper, the equations below in which the control amounts are multiplied by 1.1 are used and amounts of heat are increased more than those for plain paper.

$$Mva\times 1.1=Mva'+Mvb'\times B$$

$$Mvb\times 1.1=Mvb'+Mva'\times A \qquad 11$$

When the above equations are developed, they become as follows, and practical control amounts can be obtained.

$$Mva'=(Mva-Mvb\times B)/(1-A\times B)\times 1.1$$

$$Mvb'=(Mvb-Mva\times A)/(1-A\times B)\times 1.1 \qquad 12$$

The equation 8 is used as it is for a correction equation for the pressure roller 13. In the above example, the control amounts are multiplied by 1.1, respectively when thick paper is used, but, of course, the control amounts are not limited to the values. Only thick paper is used as an example, but the correction amounts can also be changed, of course, to a plurality of correction amounts by multiplying, for example, 1.05-fold, 1.1-fold, and 1.2-fold depending on paper thickness.

Thus, by using different correction equations when paper is thick, the temperatures of the fixing belt 10 (the first rotating member) and the pressure roller 13 (the second rotating member) can be finely controlled even though paper is thick.

Further, correction equations for the case where a paper width is smaller than the width of the fixing belt 10 (297 millimeters) and a paper thickness is large are explained. The equations 11 and 12 are for thick paper, and when a paper width is small, the temperature of the edge sometimes rises excessively. Because of this, when paper is thick and has a small width, the following equations are used, a heating amount is increased more than that for plain paper, and an increase in temperature of the edge is prevented.

$$Mva \times 1.1 = Mva' - Mvb' \times B$$

$$Mvb \times 1.1 = Mvb' + Mva' \times A \times (297/\text{paper width}) \quad 13$$

When the above equations are developed, they become as follows, and practical control amounts can be obtained.

$$Mva' = (Mva - Mvb \times B)/(1 - A \times (297/\text{paper width}) \times B) \times 1.1$$

$$Mvb' = (Mvb - Mva \times A \times (297/\text{paper width}))/(1 - A \times (297/\text{paper width}) \times B) \quad 14$$

The equation 8 is used as it is for a correction equation for the pressure roller 13. In the above example, the control amounts are multiplied by 1.1, respectively when thick paper is used, but, of course, the control amounts are not limited to the values. Further, only thick paper is used as an example, but the correction amounts can also be of course changed to a plurality of correction amounts by multiplying, for example, 1.05-fold, 1.1-fold, and 1.2-fold, respectively, depending on paper thickness.

Accordingly, by adding correction depending on paper width to correction equations for thick paper, not only can the temperatures of the fixing belt 10 (the first rotating member) and the pressure roller 13 (the second rotating member) be finely controlled but also an increase in temperature of the edges of the rotating members can be avoided even if paper is thick.

In a fifth embodiment of the present invention, an influence exerted by the center heater 14 on the edge as well as an influence exerted by the edge heater 15 on the center are taken into consideration similarly to the fourth embodiment, and control amounts for the center heater 14 and the edge heater 15 are obtained by correction equations. However, one aspect in the fifth embodiment where corrected turn-on rates calculated using different correction equations depending on turn-on rates before correction are calculated is different from the fourth embodiment. A belt type fixing device and an image forming apparatus according to the fifth embodiment are basically similar to those in the fourth embodiment. A heating control process in the fifth embodiment is the same as previously described in connection with FIG. 15, and the same explanation is not repeated.

Figure 17B:
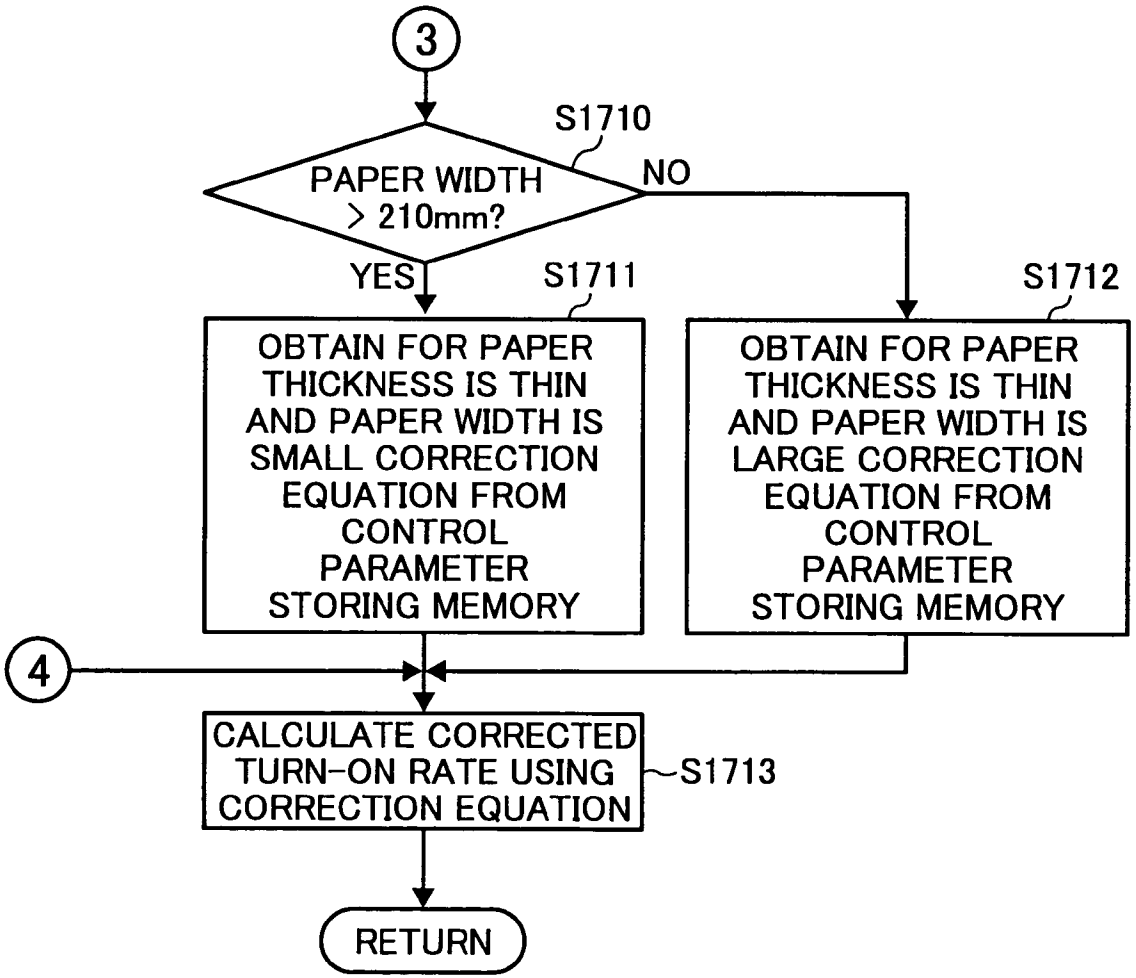
FIG. 17 is a detailed flowchart of a turn-on rate correction process shown in FIG. 15.
Figure 22:
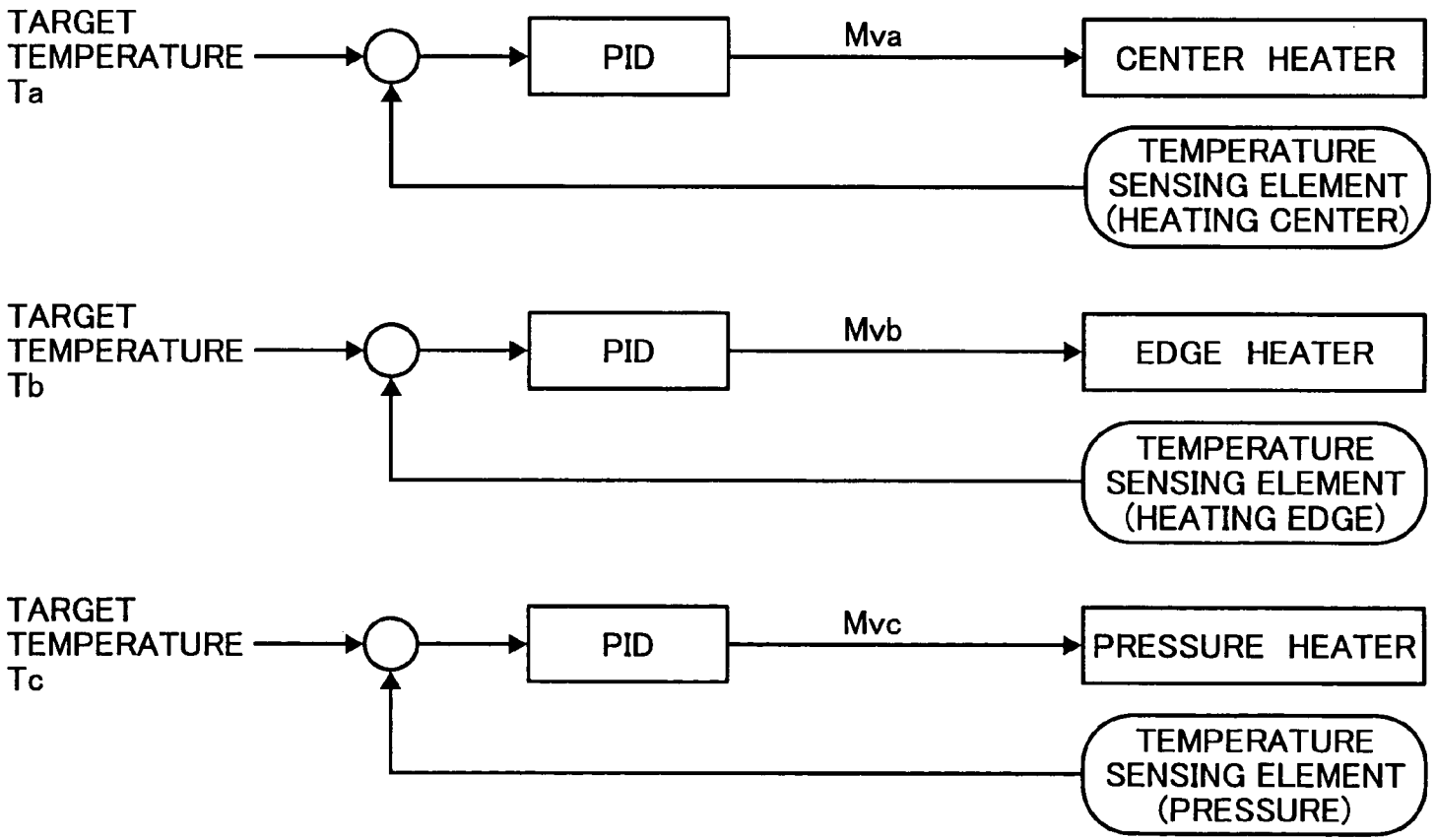
FIG. 22 is a schematic for explaining an example of conventional fixing control.

FIG. 17 is a detailed flowchart of a turn-on rate correction process that is performed by the I/O control panel. The turn-on rate correction process according to the fifth embodiment is in many respects similar to that of FIG. 13, and only different part is explained. The process at steps S1701 to S1703 is the same as that in FIG. 13, and the same explanation is not repeated.

At step S1703, when the paper thickness is determined to be "THICK" (THICK at step S1703), the I/O control panel 31 determines whether the paper width obtained exceeds 210 millimeters (step S1704). When the paper width obtained is determined to exceed 210 millimeters (Yes at step S1704), the I/O control panel 31 obtains a corresponding correction equation from the control parameter storing memory 25 (step S1705). In other words, in the table of a case where a paper width exceeds 210 millimeters and a paper thickness is "THICK", correction equations corresponding to the center heater turn-on rate Mva and the edge heater turn-on rate Mvb are obtained.

When the paper width obtained is determined not to exceed 210 millimeters, that is, it is determined to be equal to or smaller than 210 millimeters (No at step S1704), the I/O control panel 31 obtains a corresponding correction equation from the control parameter storing memory 25 (step S1706). In other words, in the table of a case where a paper width is equal to or smaller than 210 millimeters and a paper thickness is "THICK", correction equations corresponding to the center heater turn-on rate Mva and the edge heater turn-on rate Mvb are obtained.

At the step S1703, when the paper thickness is determined to be "REGULAR" (REGULAR at step S1703), the I/O control panel 31 determines whether the paper width obtained exceeds 210 millimeters (step S1707). When the paper width obtained is determined to exceed 210 millimeters (Yes at step S1707), the I/O control panel 31 obtains a corresponding correction equation from the control parameter storing memory 25 (step S1708). In other words, in the table of a case where a paper width exceeds 210 millimeters and a paper thickness is "REGULAR", correction equations corresponding to the center heater turn-on rate Mva and the edge heater turn-on rate Mvb are obtained.

When the paper width obtained is determined not to exceed 210 millimeters, that is, it is determined to be equal to or smaller than 210 millimeters (No at step S1707), the I/O control panel 31 obtains a corresponding correction equation from the control parameter storing memory 25 (step S1709). In other words, in the table of a case where a paper width is equal to or smaller than 210 millimeters and a paper thickness is "REGULAR", correction equations corresponding to the center heater turn-on rate Mva and the edge heater turn-on rate Mvb are obtained.

At the step S1703, when the paper thickness is determined to be "THIN" (THIN at step S1703), the I/O control panel 31 determines whether the paper width obtained exceeds 210 millimeters (step S1710). Then the paper width obtained is determined to exceed 210 millimeters (Yes at step S1710), the I/O control panel 31 obtains a corresponding correction equation from the control parameter storing memory 25 (step S1711). In other words, in the table of a case where a paper width exceeds 210 millimeters and a paper thickness is "THIN", correction equations corresponding to the center heater turn-on rate Mva and the edge heater turn-on rate Mvb are obtained.

When the paper width obtained is determined not to exceed 210 millimeters, that is, it is determined to be equal to or smaller than 210 millimeters (No at step S1710), the I/O control panel 31 obtains a corresponding correction equation from the control parameter storing memory 25 (step S1712). In other words, in the table of a case where a paper width is equal to or smaller than 210 millimeters and a paper thickness is "THICK", correction equations corresponding to the center heater turn-on rate Mva and the edge heater turn-on rate Mvb are obtained. The I/O control panel 31 calculates a corrected turn-on rate using the correction equation obtained (step S1713).

Here, in FIG. 17, the tables stored in the control parameter storing memory 25 are explained. FIG. 18 is an example of contents of a table of correction equations for regular thick paper with a width more than 210 millimeters. In this case, control amounts (center heater turn-on rate Mva and edge heater turn-on rate Mvb) by PID calculation for heating center and heating edge are divided into three, respectively, and Mva' and Mvb' are calculated by the correction equations in the table. Heater control is performed according to the control amounts Mva' and Mvb' calculated. Further, Mvc' is obtained using the Mva' and the Mvb' as correction values for Mvc.

FIG. 19 is an example of contents of a table of correction equations for regular thick paper with a width equal to or smaller than 210 millimeters. Since in FIG. 18, it is assumed that fixation is performed on paper of the same width as that of the fixing belt 10, there is a fear that the temperature of the edge rises excessively when the correction equations are used as they are.

Accordingly, when a paper width is equal to or smaller than 210 millimeters (when a width is narrow), the table (control table) shown in FIG. 19 is used. Note that correction values are not limited to those in the table. Further, a table of 3×3 is used in the fifth embodiment; however, the table may be, of course, divided into more than 3×3. Furthermore, the combination is not limited to Mva and Mvb, and Mvc may be used in place. Still further, it is a matter of course that Mvc is added to the table and the table may be made three-dimensional.

In the fifth embodiment, control amounts obtained by PID control are not used as they are, but heating amounts of other heat sources are taken into consideration, and the control amounts are corrected using the table. The table is not single, by using the tables properly depending on paper width, not only can the temperatures of the first and the second rotating members be finely controlled but also an increase in temperature of the edges can be avoided.

Next, the case where paper with a large thickness is used is explained. When paper is thick, more heat is drawn compared with paper with a regular thickness. Therefore the temperature sometimes decreases in the case of tables in FIGS. 18 and 19. Because of this, the I/O control panel 31 performs correction using the tables in FIGS. 20 and 21 when paper is thick. FIG. 20 is an example of contents of a table of correction equations for thick paper with a width more than 210 millimeters. FIG. 21 is an example of contents of a table of correction equations for thick paper with a width equal to or smaller than 210 millimeters.

Accordingly, by using the tables properly depending on paper thickness, control according to paper width and thickness becomes possible. Moreover, not only can the temperatures of the fixing belt 10 (the first rotating member) and the pressure roller 13 (the second rotating member) be finely controlled but also an increase in temperature of the edges can be avoided.

In the embodiments described above, heat capacities of the fixing belt 10 (the first rotating member) and the pressure roller 13 (the second rotating member) are not specifically defined. Thus, for power saving, a material that is small in heat capacity and easy to be warmed may be used for the fixing belt 10 and a material that is large in heat capacity and hard to be cooled even though paper is passed may be used for the pressure roller 13.

For example, the fixing belt 10 is formed of nickel, a thermo-resistant resin (polyimide and the like), carbon steel, stainless steel, or the like, and the surface layer thereof is coated with a thermo-resistant release layer (fluorocarbon resin, highly releasable silicon rubber, and the like). Further, the fixing roller 11 and the heating roller 12 are formed of, for example, an iron roller or an aluminum roller. The pressure roller 13 is formed of silicon rubber or the like.

Owing to this, it is possible to obtain excellent fixation by adjusting each coefficient, equation, and value in the table so as to meet the conditions described above. Of course, even if rotating members having heat capacities different from those described above are adopted, excellent fixation can be obtained by adjusting each coefficient, equation, and value in the table described above.

Accordingly, owing to the control mode explained in each embodiment, even if a heat capacity of the fixing belt 10 (the first rotating member) is different from that of the pressure roller 13 (the second rotating member), fine temperature control becomes possible by adjusting the data tables (correction tables) and correction coefficients in consideration of the difference. Further, even if a material that is small in heat capacity and easy to be warmed is used for the first rotating member and a material that is large in heat capacity and hard to be cooled even when paper is passed is used for the second rotating member for power saving, excellent fixation can be obtained.

In each embodiment described above, the example in which a plurality of temperature sensing elements are arranged is described; however, when control is possible with only one temperature sensing element in consideration of size of a fixing device and the like, the number of temperature sensing elements is not limited to this.

In the embodiments described above, the heating control device is explained as hardware; however, it can be implemented as software. In other words, a computer program (hereinafter, "heating control program") can be executed on a computer to realize the heating control process. The heating control program is installed in advance in ROM and the like, and provided.

The heating control program can be stored in a computer-readable recording medium such as compact disk-read only memory (CD-ROM), flexible disk (FD), compact disk-readable (CD-R), and digital versatile disk (DVD) in an installable or executable format.

The heating control program can also be stored in a computer connected to a network such as the Internet and downloaded via the network. The heating control program can be provided or distributed via a network such as the Internet.

The heating control program includes modules that implement each unit described above (PID control unit, correcting unit, and the like), and in hardware, a CPU (processor) loads the heating control program from the ROM into the main storage device to execute it, and the PID control unit, correcting unit, and the like are implemented on the main storage device.

As set forth hereinabove, according to an embodiment of the present invention, the temperatures of the rotating members can be finely controlled with minimum power and fixation can be secured at a stable fixing temperature by avoiding an increase in temperature of the edge of the rotating member and finely controlling the temperature of the rotating member that performs fixation through calculating the second control value to control the second heating unit based on the temperature of the member in the position corresponding to the first heating unit that is sensed by the temperature sensing unit and controlling the second heating unit with the second control value calculated.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A heating control device comprising:

a first heating unit that heats a member;

a second heating unit that heats the member;

a third heating unit that heats a pressure member, the pressure member being arranged opposite to the member and pressing the member to form a nip between the member and the press member;

a first temperature sensing unit that senses first temperature of the member in a first position corresponding to the first heating unit;

a second temperature sensing unit that senses second temperature of the member in a second position corresponding to the second heating unit;

a third temperature sensing unit that senses third temperature of the pressure member;

a first control-value calculating unit that calculates, based on the second temperature, a first control value to control the first heating unit; another control-value calculating unit that calculates, based on the first control-value, another control value to control the third heating unit; and a first control unit that controls the first heating unit with the first control.

2. The heating control device according to claim 1, further comprising:

a second control-value calculating unit that calculates a second control value to control the second heating unit from a difference value between the second temperature and a target temperature; and a second control unit that controls the second heating unit with the second control value, wherein the first control-value calculating unit calculates a first reference control value from a difference value between the first temperature and a target temperature, and then corrects, based on the second control value, the first control value corresponding to an amount of heat to be generated by the first heating unit, which is reduced by an amount of heat generated by the second heating unit that is transferred to the member in the first position.

3. The heating control device according to claim 2, further comprising a memory that stores therein a correction equation to correct the first reference control value based on a rate at which the heat generated by the second heating unit is transferred to the member in the first position, wherein the first control-value calculating unit corrects the first reference control value by using the correction equation to obtain the first control value.

4. The heating control device according to claim 3, wherein the correction equation is represented by:

$$Mvb' = Mvb - Mva \times (\text{thermal conductivity})$$

where Mvb' represents the first control value, Mvb represents the first reference control value, Mva represents the second control value, and the thermal conductivity is the rate at which the heat generated by the second heating unit is transferred to the member in the first position.

5. The heating control device according to claim 3, further comprising a medium-width obtaining unit to obtain a width of a recording medium that passes on the member, the width of the recording medium being perpendicular to a moving direction of the recording medium, wherein the correction equation corresponds to the width of the recording medium, and the first control-value calculating unit calculates a first reference control value, obtains the correction equation corresponding to the width of the recording medium from the memory, and corrects the first reference control value by using the correction equation to obtain the first control value.

6. The heating control device according to claim 5, wherein the correction equation is represented by:

$$Mvb' = Mvb - Mva \times (\text{thermal conductivity}) \times (\text{medium width coefficient})$$

where Mvb' represents the first control value, Mvb represents the first reference control value, Mva represents the second control value, the thermal conductivity is a rate at which the heat generated by the second heating unit is transferred to the member in the first position, and the medium width coefficient is a coefficient corresponding to the width of the recording medium.

7. The heating control device according to claim 3, further comprising a medium-thickness obtaining unit to obtain a thickness of a recording medium that passes on the member, wherein the correction equation corresponds to the thickness of the recording medium, and the first control value calculating unit calculates a first reference control value, obtains the correction equation corresponding to the thickness of the recording medium from the memory, and corrects the first reference control value by using the correction equation to obtain the first control value.

8. The heating control device according to claim 7, wherein the correction equation is represented by:

$$Mvb' = Mvb - Mva \times (\text{thermal conductivity}) \times (\text{medium thickness coefficient})$$

where Mvb' represents the first control value, Mvb represents the first reference control value, Mva represents the second control value, the thermal conductivity is a rate at which the heat generated by the second heating unit is transferred to the member in the first position, and the medium thickness coefficient is a coefficient corresponding to the thickness of the recording medium.

9. The heating control device according to claim 1, further comprising:

a second control-value calculating unit that calculates, based on the first temperature, a second control value to control the second heating unit; and a second control unit that controls the second heating unit with the second control value.

10. The heating control device according to claim 9, further comprising:

a first reference control-value calculating unit that calculates a first reference control value for the first heating unit from a difference value between the first temperature and a target temperature; and a second reference control-value calculating unit that calculates a second reference control value for the second heating unit from a difference value between the second temperature and a target temperature, wherein the first control-value calculating unit calculates the first control value based on the first reference control value and the second reference control value; and the second control-value calculating unit calculates the second control value based on the first reference control value and the second reference control value.

11. The heating control device according to claim 10, further comprising a medium-width obtaining unit to obtain a medium width of a recording medium that passes on the member, the width of the recording medium being perpendicular to a moving direction of the recording medium, wherein the first control-value calculating unit calculates the first control value further based on the width of the recording medium, and the second control-value calculating unit calculates the second control value further based on the width of the recording medium.

12. The heating control device according to claim 10, further comprising a medium-thickness obtaining unit that obtains a medium thickness of a recording medium that passes on the member, wherein the first control-value calculating unit calculates the first control value further based on the medium thickness, and the second control-value calculating unit calculates the second control value further based on the medium thickness.

13. The heating control device according to claim 9, further comprising:

a first reference control-value calculating unit that calculates a first reference control value for the first heating unit from a difference value between the first temperature and a target temperature;

a second reference control-value calculating unit that calculates a second reference control value for the second heating unit from a difference value between the second temperature and a target temperature; and a memory that stores therein a first correction equation corresponding to a range of the first control value including the first reference control value and a second correction equation corresponding to a range of the second control value including the second reference control value, wherein the first control-value calculating unit obtains, from the memory, the first correction equation and the second correction equation, and calculates the first control value by using the first correction equation and the second correction equation, and the second control-value calculating unit obtains, from the memory, the first correction equation and the second correction equation, and calculates the second control value by using the first correction equation and the second correction equation.

14. The heating control device according to claim 13, further comprising a medium-width obtaining unit to obtain a width of a recording medium that passes on the member, the width of the recording medium being perpendicular to a moving direction of the recording medium, wherein the range of the first control value further includes the width of the recording medium.

15. The heating control device according to claim 13, further comprising a medium-thickness obtaining unit to obtain a thickness of a recording medium that passes on the member, wherein the range of the first control value further includes the thickness of the recording medium.

16. The heating control device according to claim 1, wherein the first position corresponds to an edge of the member, and the second position corresponds to center of the member.

17. A fixing device comprising:

the heating control device according to claim 1;

a heating unit that heats the member under control of the heating control device; and a fixing unit that fixes a toner image on a recording medium with the member heated by the heating unit.

18. An image forming apparatus comprising:

the heating control device according to claim 1; and a fixing device that includes a heating unit controlled by the heating control device.

19. A heating control method that is applied to a heating control device including a first heating unit that heats a member, a second heating unit that heats the member, a first temperature sensing unit that senses first temperature of the member in a first position corresponding to the first heating unit, and a second temperature sensing unit that senses second temperature of the member in a second position corresponding to the second heating unit, the heating control method comprising:

calculating, based on the second temperature, a first control value to control the first heating unit; and controlling the first heating unit with the first control value.

20. A computer program product used in a heating control device including a first heating unit that heats a member, a second heating unit that heats the member, a first temperature sensing unit that senses first temperature of the member in a first position corresponding to the first heating unit, and a second temperature sensing unit that senses second temperature of the member in a second position corresponding to the second heating unit, the computer program product comprising a non-transitory computer usable medium having computer readable program codes embodied in the medium that when executed causes a computer to execute: calculating, based on the second temperature, a first control value to control the first heating unit; and controlling the first heating unit with the first control value.

* * * * *